US011295647B2

(12) United States Patent
Du et al.

(10) Patent No.: US 11,295,647 B2
(45) Date of Patent: Apr. 5, 2022

(54) DRIFT CONTROL CIRCUIT, DRIFT CONTROL METHOD, GATE DRIVING UNIT, GATE DRIVING METHOD AND DISPLAY DEVICE

(71) Applicants: HEFEI XINSHENG OPTOELECTRONICS TECHNOLOGY CO., LTD., Anhui (CN); BOE TECHNOLOGY GROUP CO., LTD., Beijing (CN)

(72) Inventors: Ruifang Du, Beijing (CN); Xiaoye Ma, Beijing (CN); Xiaofang Gu, Beijing (CN); Donghui Zhang, Beijing (CN); Guodong Liu, Beijing (CN)

(73) Assignees: HEFEI XINSHENG OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 225 days.

(21) Appl. No.: 16/643,226

(22) PCT Filed: Jun. 28, 2019

(86) PCT No.: PCT/CN2019/093722
§ 371 (c)(1),
(2) Date: Feb. 28, 2020

(87) PCT Pub. No.: WO2020/001625
PCT Pub. Date: Jan. 2, 2020

(65) Prior Publication Data

US 2020/0335022 A1 Oct. 22, 2020

(30) Foreign Application Priority Data

Jun. 28, 2018 (CN) ..... 201810685769.X

(51) Int. Cl.
*G09G 3/20* (2006.01)

(52) U.S. Cl.
CPC ..... *G09G 3/20* (2013.01); *G09G 2300/0426* (2013.01); *G09G 2320/045* (2013.01); *G09G 2330/028* (2013.01)

(58) Field of Classification Search
CPC ..... G09G 3/20; G09G 2300/0426; G09G 2320/045; G09G 2330/028
(Continued)

(56) References Cited

U.S. PATENT DOCUMENTS

2010/0238143 A1 9/2010 Liu et al.
2015/0248940 A1* 9/2015 Yang ..... G09G 3/3677 377/64
(Continued)

FOREIGN PATENT DOCUMENTS

CN 104078021 A 10/2014
CN 105185349 A 12/2015
(Continued)

OTHER PUBLICATIONS

The First Office Action dated Dec. 20, 2019 corresponding to Chinese application No. 201810685769.X.

*Primary Examiner* — Mark Edwards
(74) *Attorney, Agent, or Firm* — Nath, Goldberg & Meyer; Joshua B. Goldberg

(57) ABSTRACT

The present disclosure provides a drift control circuit, a drift control method, a gate driving unit, a gate driving method and a display device. The drift control circuit includes: a first drift control sub-circuit configured to, during noise releasing performed by the first pull-down module, control first electrodes of pull-down transistors included in the second pull-down module to be coupled to a first control voltage terminal, which is configured to input a first voltage to the
(Continued)

first pull-down module during noise releasing performed by the first pull-down module; and a second drift control sub-circuit configured to, during noise releasing performed by the second pull-down module, control first electrodes of pull-down transistors included in the first pull-down module to be coupled to a second control voltage terminal, which is configured to input the first voltage to the second pull-down module during noise releasing performed by the second pull-down module.

18 Claims, 8 Drawing Sheets

(58) Field of Classification Search
USPC ..... 345/55
See application file for complete search history.

(56) References Cited

U.S. PATENT DOCUMENTS

| | | | | |
|---|---|---|---|---|
| 2016/0225462 | A1 | 8/2016 | Harada | |
| 2018/0108426 | A1* | 4/2018 | Zheng | G11C 19/184 |

FOREIGN PATENT DOCUMENTS

| | | | |
|---|---|---|---|
| CN | 105528985 | A | 4/2016 |
| CN | 106297617 | A | 1/2017 |
| CN | 106409200 | A | 2/2017 |
| CN | 108877620 | A | 11/2018 |

* cited by examiner

DRIFT CONTROL CIRCUIT, DRIFT CONTROL METHOD, GATE DRIVING UNIT, GATE DRIVING METHOD AND DISPLAY DEVICE

CROSS-REFERENCE TO RELATED APPLICATIONS

This is a National Phase Application filed under 35 U.S.C. 371 as a national stage of PCT/CN2019/093722, filed on Jun. 28, 2019, an application claiming priority to Chinese patent application No. 201810685769.X, filed on Jun. 28, 2018, the entire contents of each of which are incorporated herein by reference.

TECHNICAL FIELD

The present disclosure relates to the field of display driving technology, and more particularly, to a drift control circuit, a drift control method, a gate driving unit, a gate driving method and a display device.

BACKGROUND

A gate driving circuit arranged on an array substrate (Gate On Array, GOA) includes multiple stages of gate driving units, and has the advantages of reducing cost, improving module process yield, being beneficial to realizing narrow bezel and the like, and as a result, the GOA technology is more and more widely used in display panels. The key point of the GOA technology is the reliability of the gate driving unit and the gate driving circuit.

SUMMARY

The present disclosure provides a drift control circuit applied to a gate driving unit, the gate driving unit includes a first pull-down module and a second pull-down module, the drift control circuit includes a first drift control sub-circuit and a second drift control sub-circuit, the first drift control sub-circuit is configured to control first electrodes of pull-down transistors included in the second pull-down module to be coupled to a first control voltage terminal during noise releasing performed by the first pull-down module, and the first control voltage terminal is configured to input a first voltage to the first pull-down module during noise releasing performed by the first pull-down module; and the second drift control sub-circuit is configured to control first electrodes of pull-down transistors included in the first pull-down module to be coupled to a second control voltage terminal during noise releasing performed by the second pull-down module, the second control voltage terminal is configured to input the first voltage to the second pull-down module during noise releasing performed by the second pull-down module, wherein gate electrodes of the pull-down transistors included in the first pull-down module are coupled to a first pull-down node, gate electrodes of the pull-down transistors included in the second pull-down module are coupled to a second pull-down node, an interconnection point between the gate electrodes of two pull-down transistors included in the first pull-down module is the first pull-down node, and an interconnection point between the gate electrodes of two pull-down transistors included in the second pull-down module is the second pull-down node.

In an embodiment, the first drift control sub-circuit is further configured to control the first electrodes of the pull-down transistors included in the second pull-down module to be supplied with a second voltage during noise releasing performed by the second pull-down module; and the second drift control sub-circuit is further configured to control the first electrodes of the pull-down transistors included in the first pull-down module to be supplied with the second voltage during noise releasing performed by the first pull-down module.

In an embodiment, the first drift control sub-circuit includes: a first drift control transistor, a gate electrode of the first drift control transistor being coupled to a first drift control terminal, a first electrode of the first drift control transistor being coupled to a first bias terminal, and a second electrode of the first drift control transistor being coupled to the first control voltage terminal; and a second drift control transistor, a gate electrode of the second drift control transistor being coupled to a second drift control terminal, a first electrode of the second drift control transistor being coupled to the first bias terminal, and a second electrode of the second drift control transistor being coupled to a second voltage terminal, wherein the first bias terminal is coupled to the first electrodes of the pull-down transistors included in the second pull-down module.

In an embodiment, the second drift control sub-circuit includes: a third drift control transistor, a gate electrode of the third drift control transistor being coupled to the second drift control terminal, a first electrode of the third drift control transistor being coupled to a second bias terminal, and a second electrode of the third drift control transistor being coupled to the second control voltage terminal; and a fourth drift control transistor, a gate electrode of the fourth drift control transistor being coupled to the first drift control terminal, a first electrode of the fourth drift control transistor being coupled to the second bias terminal, a second electrode of the fourth drift control transistor being coupled to the second voltage terminal, wherein the second bias terminal is coupled to the first electrodes of the pull-down transistors included in the first pull-down module.

In an embodiment, the first control voltage terminal is a first voltage terminal; or the first control voltage terminal is coupled to the first drift control terminal; or the first control voltage terminal is coupled to the first pull-down node.

In an embodiment, the second control voltage terminal is a first voltage terminal; or the second control voltage terminal is coupled to the second drift control terminal; or the second control voltage terminal is coupled to the second pull-down node.

In an embodiment, in a case where the gate driving unit further includes a first pull-down node control module, the first control voltage terminal is coupled to a first pull-down control node to which the first pull-down node control module is coupled.

In an embodiment, in a case where the gate driving unit further includes a second pull-down node control module, the second control voltage terminal is coupled to a second pull-down control node to which the second pull-down node control module is coupled.

The present disclosure further provides a drift control method applied to the drift control circuit described above, the drift control method including: during noise releasing performed by the first pull-down module, outputting, by the first control voltage terminal, the first voltage to the first pull-down module, and controlling, by the first drift control sub-circuit, the first electrodes of the pull-down transistors included in the second pull-down module to be coupled to the first control voltage terminal; and during noise releasing performed by the second pull-down module, inputting, by the second control voltage terminal, the first voltage to the second pull-down module, and controlling, by the second drift control sub-circuit, the first electrodes of the pull-down transistors included in the first pull-down module to be coupled to the second control voltage terminal.

The present disclosure further provides a gate driving unit, including: a first pull-down module including pull-down transistors, gate electrodes of which are coupled to a first pull-down node, an interconnection point of the gate electrodes of two pull-down transistors included in the first pull-down module being the first pull-down node; a second pull-down module including pull-down transistors, gate electrodes of which are coupled to a second pull-down node, an interconnection point of the gate electrodes of two pull-down transistors included in the second pull-down module being the second pull-down node; the drift control circuit of the present disclosure, wherein the drift control circuit includes a first drift control sub-circuit coupled to first electrodes of the pull-down transistors included in the second pull-down module, and a second drift control sub-circuit coupled to first electrodes of the pull-down transistors included in the first pull-down module.

In an embodiment, the first pull-down module includes: a first pull-down transistor, a gate electrode of the first pull-down transistor being coupled to the first pull-down node, a first electrode of the first pull-down transistor being coupled to a second bias terminal, and a second electrode of the first pull-down transistor being coupled to a pull-up node; a second pull-down transistor, a gate electrode of the second pull-down transistor being coupled to the first pull-down node, a first electrode of the second pull-down transistor being coupled to the second bias terminal, and a second electrode of the second pull-down transistor being coupled to a gate driving signal output terminal; the second pull-down module includes: a third pull-down transistor, a gate electrode of the third pull-down transistor being coupled to the second pull-down node, a first electrode of the third pull-down transistor being coupled to a first bias terminal, and a second electrode of the third pull-down transistor being coupled to the pull-up node; and a fourth pull-down transistor, a gate electrode of the fourth pull-down transistor being coupled to the second pull-down node, a first electrode of the fourth pull-down transistor being coupled to the first bias terminal, and a second electrode of the fourth pull-down transistor being coupled to the gate driving signal output terminal.

In an embodiment, the gate driving unit further includes a first pull-down node control module and a second pull-down node control module; the first pull-down node control module includes: a first pull-down node control transistor, a gate electrode and a first electrode of the first pull-down node control transistor being both coupled to a first drift control terminal, and a second electrode of the first pull-down node control transistor being coupled to a first pull-down control node; a second pull-down node control transistor, a gate electrode of the second pull-down node control transistor being coupled to a pull-up node, a first electrode of the second pull-down node control transistor being coupled to the first pull-down control node, and a second electrode of the second pull-down node control transistor being coupled to a second voltage terminal; a third pull-down node control transistor, a gate electrode of the third pull-down node control transistor being coupled to the first pull-down control node, a first electrode of the third pull-down node control transistor being coupled to the first drift control terminal, and a second electrode of the third pull-down node control transistor being coupled to the first pull-down node; and a fourth pull-down node control transistor, a gate electrode of the fourth pull-down node control transistor being coupled to the pull-up node, a first electrode of the fourth pull-down node control transistor being coupled to the first pull-down node, and a second electrode of the fourth pull-down node control transistor being coupled to the second voltage terminal, and the first pull-down node control module is configured to control a potential of the first pull-down control node under control of the first drift control terminal and to control a potential of the first pull-down node under control of the first pull-down control node; the second pull-down node control module includes: a fifth pull-down node control transistor, a gate electrode and a first electrode of the fifth pull-down node control transistor being both coupled to a second drift control terminal, and a second electrode of the fifth pull-down node control transistor being coupled to a second pull-down control node; a sixth pull-down node control transistor, a gate electrode of the sixth pull-down node control transistor being coupled to the pull-up node, a first electrode of the sixth pull-down node control transistor being coupled to the second pull-down control node, and a second electrode of the sixth pull-down node control transistor being coupled to the second voltage terminal; a seventh pull-down node control transistor, a gate electrode of the seventh pull-down node control transistor being coupled to the second pull-down control node, a first electrode of the seventh pull-down node control transistor being coupled to the second drift control terminal, and a second electrode of the seventh pull-down node control transistor being coupled to the second pull-down node; and an eighth pull-down node control transistor, a gate electrode of the eighth pull-down node control transistor being coupled to the pull-up node, a first electrode of the eighth pull-down node control transistor being coupled to the second pull-down node, and a second electrode of the eighth pull-down node control transistor being coupled to the second voltage terminal, and the second pull-down node control module is configured to control a potential of the second pull-down control node under control of the second drift control terminal, and to control a potential of the second pull-down node under control of the second pull-down control node.

In an embodiment, the gate driving unit further includes an input module, a reset module, an output module and a start module, wherein the input module is respectively coupled to an input terminal and a pull-up node and configured to control a potential of the pull-up node under control of the input terminal, the reset module is respectively coupled to a first reset terminal, a second reset terminal, the pull-up node, a gate driving signal output terminal and a reset voltage terminal, and configured to control the potential of the pull-up node under control of the first reset terminal and control a potential of the gate driving signal output terminal under control of the second reset terminal, the output module is respectively coupled to the pull-up node, the gate driving signal output terminal and a clock signal input terminal, and configured to control the potential of the gate driving signal output terminal under control of the pull-up node, and the start module is respectively coupled to a start control terminal, the pull-up node, the gate driving signal output terminal and the start voltage terminal and configured to control the potential of the pull-up node and the potential of the gate driving signal output terminal under control of the start control terminal.

The present disclosure further provides a gate driving method applied to the gate driving unit described above, the gate driving method including: during noise releasing performed by the first pull-down module, inputting, by a first control voltage terminal, a first voltage to the first pull-down module, and controlling, by the first drift control sub-circuit, the first electrodes of the pull-down transistors included in the second pull-down module to be coupled to the first control voltage terminal; and during noise releasing performed by the second pull-down module, inputting, by a second control voltage terminal, the first voltage to the second pull-down module, and controlling, by the second drift control sub-circuit, the first electrodes of the pull-down transistors included in the first pull-down module to be coupled to the second control voltage terminal.

In an embodiment, the gate driving unit further includes a first pull-down node control module and a second pull-down node control module, and the gate driving method includes: in a first pull-down period, inputting, by the first control voltage terminal, the first voltage to the first pull-down module, controlling, by the first pull-down node control module and under control of the first drift control terminal, a potential of the first pull-down node to be the first voltage, controlling, by the second drift control sub-circuit, the first electrodes of the pull-down transistors included in the first pull-down module to be supplied with a second voltage, controlling, by the first pull-down module and under control of the first pull-down node, noise releasing for the pull-up node and the gate driving signal output terminal, and controlling, by the first drift control sub-circuit, the first electrodes of the pull-down transistors included in the second pull-down module to be coupled to the first control voltage terminal; and in a second pull-down period, inputting, by the second control voltage terminal, the first voltage to the second pull-down module, controlling, by the second pull-down node control module and under control of the second drift control terminal, a potential of the second pull-down node to be the first voltage, controlling, by the first drift control sub-circuit, the first electrodes of the pull-down transistors included in the second pull-down module to be supplied with the second voltage, controlling, by the second pull-down module and under control of the second pull-down node, noise releasing for the pull-up node and the gate driving signal output terminal, and controlling, by the second drift control sub-circuit, the first electrodes of the pull-down transistors included in the first pull-down module to be coupled to the second control voltage terminal, wherein the first pull-down module is respectively coupled to the pull-up node and the gate driving signal output terminal, and the second pull-down module is respectively coupled to the pull-up node and the gate driving signal output terminal, the first pull-down node control module is respectively coupled to the first drift control terminal and the first pull-down node, the second pull-down node control module is respectively coupled to the second drift control terminal and the second pull-down node, an interconnection point of the gate electrodes of two pull-down transistors included in the first pull-down module is the first pull-down node, and an interconnection point of the gate electrodes of two pull-down transistors included in the second pull-down module is the second pull-down node.

In an embodiment, a signal output by the first drift control terminal and a signal output by the second drift control terminal have a same period but opposite phases.

In an embodiment, one of a first half period and a second half period of the period is the first pull-down period, and the other of the first half period and the second half period of the period is the second pull-down period.

The present disclosure further provides a display device, including the gate driving unit described above.

DETAILED DESCRIPTION

Figure 1:
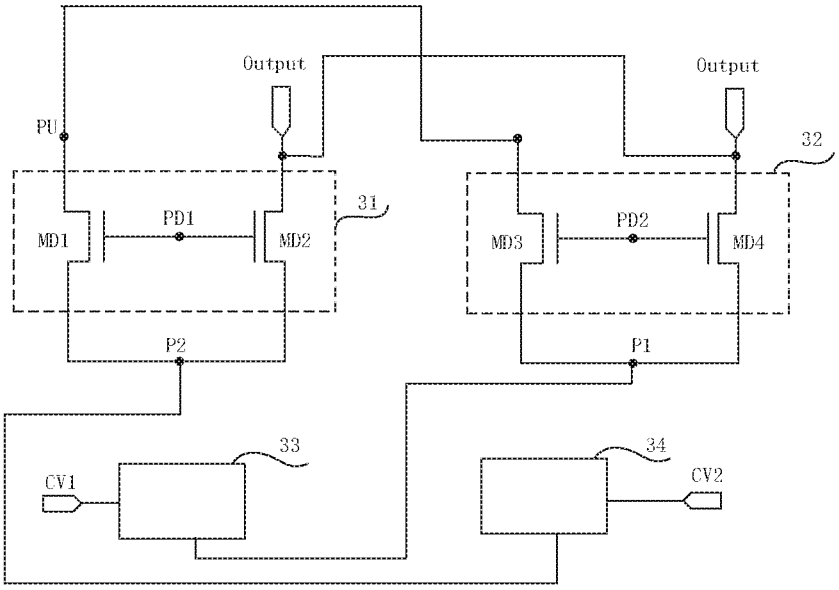
FIG. 1 is a structural diagram of a drift control circuit according to an embodiment of the present disclosure.

The technical solutions in the embodiments of the present disclosure will be described clearly and completely with reference to the drawings in the embodiments of the present disclosure, and it is obvious that the embodiments described are only some embodiments, rather than all embodiments, of the present disclosure. All other embodiments, which can be derived by a person skilled in the art from the embodiments disclosed herein without making any creative effort, shall fall within the protection scope of the present disclosure.

Transistors employed in all embodiments of the present disclosure may be thin film transistors, field effect transistors or other devices of the same characteristics. In the embodiments of the present disclosure, to distinguish two electrodes of a transistor except for a gate, one of the two electrodes is referred to as a first electrode, and the other electrode is referred to as a second electrode. In an embodiment, the first electrode may be a drain electrode and the second electrode may be a source electrode; alternatively, the first electrode may be a source electrode and the second electrode may be a drain electrode.

In some cases, a gate driving unit includes a first pull-down module, a second pull-down module, a first pull-down node control module, and a second pull-down node control module, the first pull-down module is coupled to the first pull-down node, the first pull-down node control module is configured to control a potential of the first pull-down node, the second pull-down module is coupled to the second pull-down node, and the second pull-down node control module is configured to control a potential of the second pull-down node. The first pull-down module and the second pull-down module alternately perform noise releasing on the pull-up node and the gate driving signal output terminal (for example, one period is 4 seconds, the first pull-down module performs noise releasing within 2 seconds of the period, and the second pull-down module performs noise releasing within the other 2 seconds of the period). In this case, for the pull-down transistors included in the first pull-down module and the pull-down transistors included in the second pull-down module, a forward stress time lasting for 2 seconds exists every 4 seconds, and thus a threshold voltage drift phenomenon of the pull-down transistors is severe, which results in low reliability of the gate driving unit and the gate driving circuit.

In view of this, an embodiment of the present disclosure provides a drift control circuit, which is applied to a gate driving unit. The gate driving unit includes a first pull-down module and a second pull-down module; gate electrodes of pull-down transistors included in the first pull-down module are coupled to a first pull-down node, gate electrodes of pull-down transistors included in the second pull-down module are coupled to a second pull-down node, an interconnection point between gate electrodes of two pull-down transistors included in the first pull-down module is the first pull-down node, and an interconnection point between gate electrodes of two pull-down transistors included in the second pull-down module is the second pull-down node; the drift control circuit includes a first drift control sub-circuit and a second drift control sub-circuit.

The first drift control sub-circuit is configured to control first electrodes of the pull-down transistors included in the second pull-down module to be coupled to a first control voltage terminal when the first pull-down module performs noise releasing, and the first control voltage terminal is configured to input a first voltage to the first pull-down module when the first pull-down module performs noise releasing.

The second drift control sub-circuit is configured to control first electrodes of the pull-down transistors included in the first pull-down module to be coupled to a second control voltage terminal when the second pull-down module performs noise releasing, and the second control voltage terminal is configured to input the first voltage to the second pull-down module when the second pull-down module performs noise releasing.

In the drift control circuit according to the embodiment of the present disclosure, the first drift control sub-circuit and the second drift control sub-circuit are adopted to control, when the first pull-down module performs noise releasing, the first electrodes of the pull-down transistors included in the second pull-down module to be supplied with the first voltage, so that the pull-down transistors included in the second pull-down module are in a reverse bias state, and control, when the second pull-down module performs noise releasing, the first electrodes of the pull-down transistors included in the first pull-down module to be supplied with the first voltage, so that the pull-down transistors included in the first pull-down module are in a reverse bias state, thereby alleviating the threshold voltage drift phenomenon of the pull-down transistors and improving the reliability.

In an embodiment, the first pull-down module is configured to control the noise releasing of the pull-up node and the gate driving signal output terminal under the control of the first pull-down node during a first pull-down period; and the second pull-down module is configured to control the noise releasing of the pull-up node and the gate driving signal output terminal under the control of the second pull-down node during a second pull-down period.

According to an embodiment, the pull-down transistors are N-type transistors, the first voltage is of a high level, and the first drift control sub-circuit is configured to, in the first pull-down period, control the first electrodes of the pull-down transistors included in the second pull-down module to be supplied with the high level, so that the pull-down transistors included in the second pull-down module are in a reverse bias state, thus alleviating the threshold drift of the pull-down transistors included in the second pull-down module and improving the reliability of the pull-down transistors; the second drift control sub-circuit is configured to, in the second pull-down period, control the first electrodes of the pull-down transistors included in the first pull-down module to be supplied with the high level, so that the pull-down transistors included in the first pull-down module are in a reverse bias state, thus alleviating the threshold drift of the pull-down transistors included in the first pull-down module and improving reliability of the pull-down transistors.

According to another embodiment, the pull-down transistors are P-type transistors, the first voltage is of a low voltage, and the first drift control sub-circuit is configured to, in the first pull-down period, control the first electrodes of the pull-down transistors included in the second pull-down module to be supplied with the low voltage, so that the pull-down transistors included in the second pull-down module are in a reverse bias state, thus alleviating the threshold drift of the pull-down transistors included in the second pull-down module, and improving the reliability of the pull-down transistors; the second drift control sub-circuit is configured to, in the second pull-down period, control the first electrodes of the pull-down transistors included in the first pull-down module to be supplied with the low voltage, so that the pull-down transistors included in the first pull-down module are in a reverse bias state, thus alleviating the threshold drift of the pull-down transistors included in the first pull-down module, and improving reliability of the pull-down transistors.

In an embodiment, the first drift control sub-circuit is further configured to, when the second pull-down module performs noise releasing, control the first electrodes of the pull-down transistors included in the second pull-down module to be supplied with a second voltage, so that the pull-down transistors included in the second pull-down module can be turned on.

The second drift control sub-circuit is further configured to, when the first pull-down module performs noise releasing, control the first electrodes of the pull-down transistors included in the first pull-down module to be supplied with the second voltage, so that the pull-down transistors included in the first pull-down module can be turned on.

Specifically, in the case where the pull-down transistors are N-type transistors, the second voltage may be a low voltage, and in the case where the pull-down transistors are P-type transistors, the second voltage may be of a high level.

The drift control circuit according to the embodiments of the present disclosure is applied to a gate driving unit. As shown in FIG. 1, the gate driving unit includes a first pull-down node PD1, a second pull-down node PD2, a first pull-down module 31, and a second pull-down module 32, and the drift control circuit includes a first drift control sub-circuit 33 and a second drift control sub-circuit 34.

The first pull-down module 31 includes a first pull-down transistor MD1 and a second pull-down transistor MD2, and the second pull-down module 32 includes a third pull-down transistor MD3 and a fourth pull-down transistor MD4.

A gate electrode of the first pull-down transistor MD1 is coupled to the first pull-down node PD1, a drain electrode of the first pull-down transistor MD1 is coupled to the pull-up node PU, and a source electrode of the first pull-down transistor MD1 is coupled to a second bias terminal P2.

A gate electrode of the second pull-down transistor MD2 is coupled to the first pull-down node PD1, a drain electrode of the second pull-down transistor MD2 is coupled to a gate driving signal output terminal Output, and a source electrode of the second pull-down transistor MD2 is coupled to the second bias terminal P2.

A gate electrode of the third pull-down transistor MD3 is coupled to the second pull-down node PD2, a drain electrode of the third pull-down transistor MD3 is coupled to the pull-up node PU, and a source electrode of the third pull-down transistor MD3 is coupled to the first bias terminal P1.

A gate electrode of the fourth pull-down transistor MD4 is coupled to the second pull-down node PD2, a drain electrode of the fourth pull-down transistor MD4 is coupled to the gate driving signal output terminal Output, and a source electrode of the fourth pull-down transistor MD4 is coupled to the first bias terminal P1.

The first drift control sub-circuit 33 is coupled to the source electrode of the third pull-down transistor MD3 and the source electrode of the fourth pull-down transistor MD4 (i.e. the first drift control sub-circuit 33 is coupled to the first bias terminal P1), and the first drift control sub-circuit 33 is configured to control the first bias terminal P1 and a first control voltage terminal CV1 to be coupled to each other during a first pull-down period included in a display time (during the first pull-down period, a high level is input via CV1 to the first pull-down module), so that MD3 and MD4 are in a reverse bias state, thus alleviating the threshold voltage drift of MD3 and MD4. The display time is a time during which the display device is operated to display.

The second drift control sub-circuit 34 is coupled to the source electrode of the first pull-down transistor MD1 and the source electrode of the second pull-down transistor MD2 (i.e. the second drift control sub-circuit 34 is coupled to the second bias terminal P2), and the second drift control sub-circuit 34 is configured to control the second bias terminal P2 and the second control voltage terminal CV2 to be coupled to each other during a second pull-down period included in the display time (during the second pull-down period, a high level is input via CV2 to the second pull-down module) so that MD1 and MD2 are in a reverse bias state, thus alleviating the threshold voltage drift of MD1 and MD2.

In the embodiment shown in FIG. 1, MD1, MD2, MD3, and MD4 are all N-type transistors, but the present disclosure is not limited thereto. In an embodiment, MD1, MD2, MD3, and MD4 may also be replaced with P-type transistors.

In some cases, when the drift control circuit shown in FIG. 1 is in operation, the ratio between the duration of the first pull-down period and the duration of the second pull-down period is within a predetermined ratio, which is greater than or equal to 0.9 and less than or equal to 1.1, so that there is no significant difference between the time for which the pull-down transistors are subjected to forward stress and the time for which the pull-down transistors are in a reverse bias state, thereby improving the threshold drift of the pull-down transistors.

Specifically, the first drift control sub-circuit may include a first drift control transistor and a second drift control transistor, a gate electrode of the first drift control transistor is coupled to a first drift control terminal, a first electrode of the first drift control transistor is coupled to the first bias terminal, a second electrode of the first drift control transistor is coupled to the first control voltage terminal, a gate electrode of the second drift control transistor is coupled to a second drift control terminal, a first electrode of the second drift control transistor is coupled to the first bias terminal, a second electrode of the second drift control transistor is coupled to a second voltage terminal, and the first bias terminal is coupled to the first electrodes of the pull-down transistors included in the second pull-down module.

In an embodiment, in the case where the first drift control transistor and the second drift control transistor are both N-type transistors, the first electrode may be a source electrode and the second electrode may be a drain electrode. In this case, specifically, as shown in FIG. 2, on the basis of the drift control circuit shown in FIG. 1, the first drift control sub-circuit 33 includes a first drift control transistor M_1 and a second drift control transistor M_2, a gate electrode of M_1 is coupled to a first drift control terminal VDD1, a drain electrode of M_1 is coupled to the first control voltage terminal CV1, and a source electrode of M_1 is coupled to the first bias terminal P1; a gate electrode of M_2 is coupled to a second drift control terminal VDD2, a drain electrode of M_2 is supplied with a low voltage VSS, and a source electrode of M_2 is coupled to the first bias terminal P1; the first bias terminal P1 is coupled to the source electrode of MD3 and the source electrode of MD 4.

Figure 2:
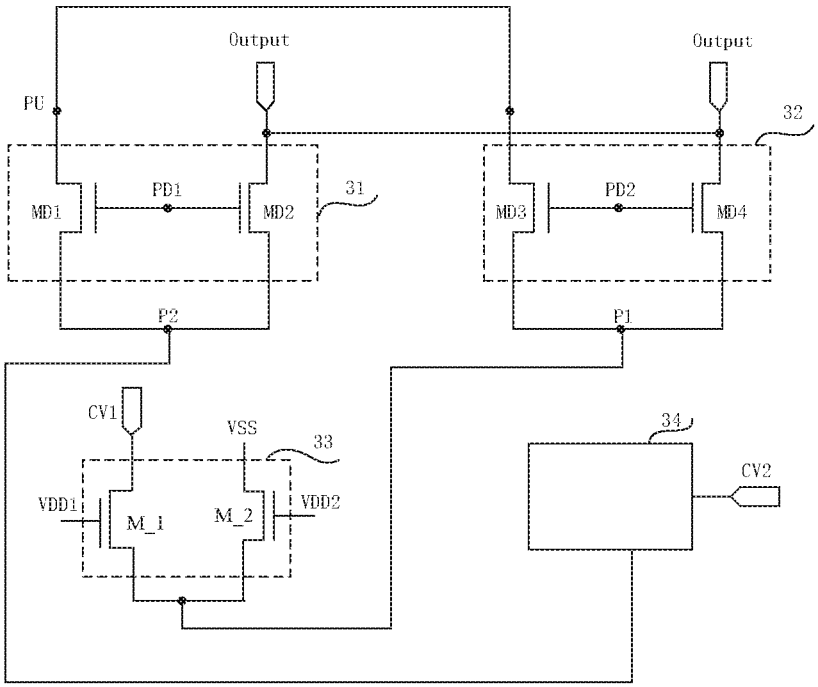
FIG. 2 is a circuit diagram of a drift control circuit according to another embodiment of the present disclosure.

In operation of the example shown in FIG. 2, in the first pull-down period, VDD1 outputs a high level, VDD2 outputs a low level, CV1 outputs a high level to be input to the first pull-down module, the potential of PD1 is at a high level, and MD1 and MD2 are both turned on to release noise for PU and Output; M_1 is turned on, and M_2 is turned off, so that P1 is coupled to CV1, the potential of P1 becomes a high level, and MD3 and MD4 can be in a reverse bias state, thereby alleviating the threshold drift of MD3 and the threshold drift of MD4.

In an embodiment, the first control voltage terminal may be a first voltage terminal; alternatively, the first control voltage terminal may be coupled to the first drift control terminal; alternatively, the first control voltage terminal may be coupled to the first pull-down node.

In an embodiment, the gate driving unit may further include a first pull-down node control module coupled to the first drift control terminal, a first pull-down control node, and the first pull-down node, respectively, and configured to control a potential of the first pull-down control node under the control of the first drift control terminal and control a potential of the first pull-down node under the control of the first pull-down control node, and the first control voltage terminal may be coupled to the first pull-down control node.

Specifically, the second drift control sub-circuit may include a third drift control transistor and a fourth drift control transistor, a gate electrode of the third drift control transistor is coupled to the second drift control terminal, a first electrode of the third drift control transistor is coupled to the second bias terminal, and a second electrode of the third drift control transistor is coupled to the second control voltage terminal; a gate electrode of the fourth drift control transistor is coupled to the first drift control terminal, a first electrode of the fourth drift control transistor is coupled to the second bias terminal, and a second electrode of the fourth drift control transistor is coupled to the second voltage terminal; the second bias terminal is coupled to the first electrodes of the pull-down transistors included in the first pull-down module.

In an embodiment, in the case where the third drift control transistor and the fourth drift control transistor are both N-type transistors, the first electrode may be a source electrode and the second electrode may be a drain electrode. In this case, specifically, as shown in FIG. 3, on the basis of the drift control circuit shown in FIG. 1, the second drift control sub-circuit 34 includes a third drift control transistor M_3 and a fourth drift control transistor M_4, a gate electrode of M_3 is coupled to the second drift control terminal VDD2, a source electrode of M_3 is coupled to the second bias terminal P2, and a drain electrode of M_3 is coupled to the second control voltage terminal CV2; a gate electrode of M_4 is coupled to the first drift control terminal VDD1, a source electrode of M_4 is coupled to the second bias terminal P2, and a drain electrode of M_4 is supplied with the low voltage VSS; the second bias terminal P2 is coupled to the source electrode of MD1 and the source electrode of MD2.

Figure 3:
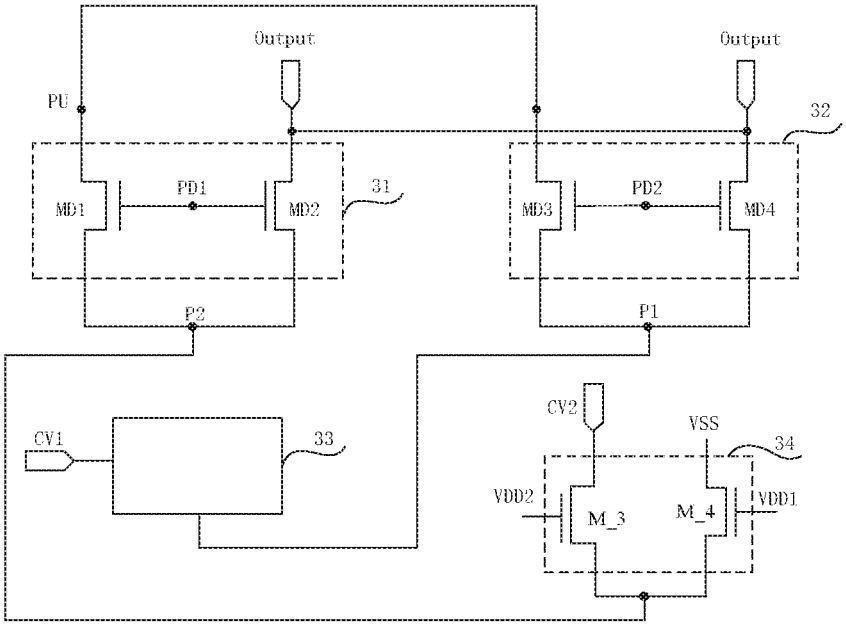
FIG. 3 is a circuit diagram of a drift control circuit according to yet another embodiment of the present disclosure.

In operation of the example shown in FIG. 3, in the second pull-down period, VDD2 outputs a high level, VDD1 outputs a low level, CV2 outputs a high level to be input to the second pull-down module, the potential of PD2 is at a high level, MD3 and MD4 are both turned on to release noise for PU and Output, M_3 is turned on, M_4 is turned off to couple P2 to CV2, and the potential of P2 becomes a high level, so that MD1 and MD2 can be in a reverse bias state, thereby alleviating the threshold drift of MD1 and MD2.

In an embodiment, the second control voltage terminal may be a first voltage terminal; alternatively, the second control voltage terminal may be coupled to the second drift control terminal; alternatively, the second control voltage terminal may be coupled to the second pull-down node.

In an embodiment, the gate driving unit may further include a second pull-down node control module. The second pull-down node control module is respectively coupled to the second drift control terminal, a second pull-down control node and the second pull-down node, and configured to control the potential of the second pull-down control node under the control of the second drift control terminal, and control the potential of the second pull-down node under the control of the second pull-down control node, and the second control voltage terminal may be coupled to the second pull-down control node.

The drift control circuit is described in detail below. In the example of the drift control circuit shown in FIG. 4, based on the drift control circuit shown in FIG. 1, the first control voltage terminal CV1 is coupled to the first pull-down node PD1, and the second control voltage terminal CV2 is coupled to the second pull-down node PD2.

The first drift control sub-circuit 33 includes a first drift control transistor M_1 and a second drift control transistor M_2, a gate electrode of M_1 is coupled to the first drift control terminal VDD1, a drain electrode of M_1 is coupled to the first pull-down node PD1, and a source electrode of M_1 is coupled to the first bias terminal P1; a gate electrode of M_2 is coupled to the second drift control terminal VDD2, a drain electrode of M_2 is supplied with the low voltage VSS, and a source electrode of M_2 is coupled to the first bias terminal P1; the first bias terminal P1 is coupled to the source electrode of MD3 and the source electrode of MD 4.

The second drift control sub-circuit 34 includes a third drift control transistor M_3 and a fourth drift control transistor M_4, a gate electrode of M_3 is coupled to the second drift control terminal VDD2, a drain electrode of M_3 is coupled to the second pull-down node PD2, and a source electrode of M_3 is coupled to the second bias terminal P2; a gate electrode of M_4 is coupled to the first drift control terminal VDD1, a drain electrode of M_4 is supplied with the low voltage VSS, and a source electrode of M_4 is coupled to the second bias terminal P2; the second bias terminal P2 is coupled to the source electrode of MD1 and the source electrode of MD2.

Figure 4:
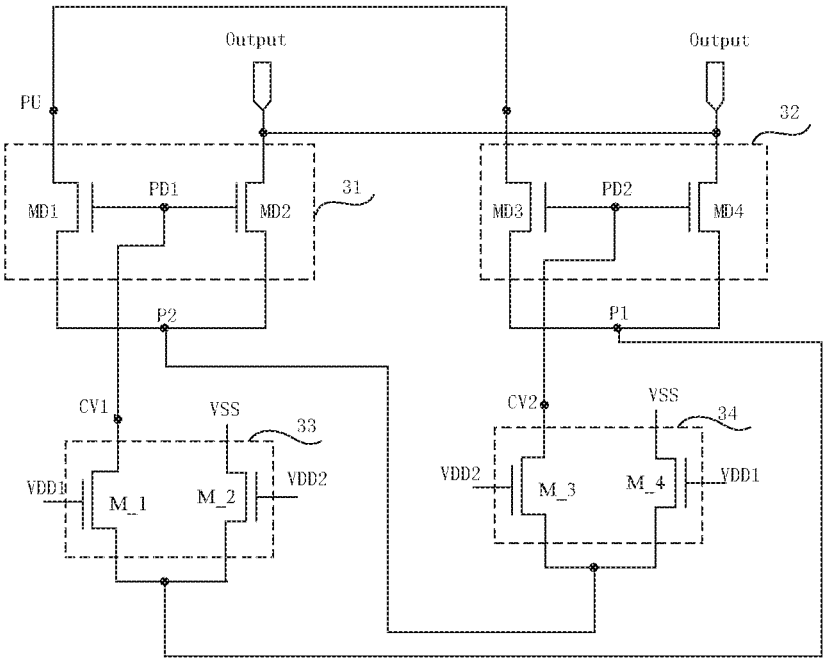
FIG. 4 is a circuit diagram of an example of a drift control circuit according to still another embodiment of the present disclosure.

In the example shown in FIG. 4, each transistor is an N-type transistor, but the disclosure is not limited thereto. In an embodiment, the transistors may also be replaced with P-type transistors.

Figure 5:
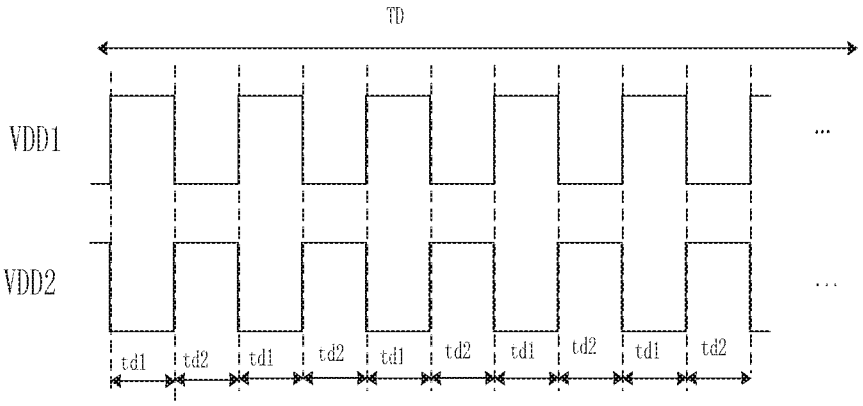
FIG. 5 is an operational timing diagram of an example of a drift control circuit according to still another embodiment of the present disclosure.

As shown in FIG. 5, when the threshold voltage drift module shown in FIG. 4 is in operation, the display time TD includes first pull-down periods td1 and second pull-down periods td2 which are alternately arranged (the first drift control signal output by VDD1 and the second drift control signal output by VDD2 are both clock signals, and the first drift control signal is inverted in phase with respect to the second drift control signal to control M_1 and M_2 to be alternately turned on, and control M_3 and M_4 to be alternately turned on).

In the first pull-down period td1, VDD1 outputs a high level, VDD2 outputs a low level, the potential of PD1 is at a high level, M_1 and M_4 are turned on, M_2 and M_3 are turned off, PD1 is coupled to P1, and P2 is supplied with VSS, so that MD1 and MD2 are turned on to release noise for PU and Output through MD1 and MD2, and the source electrode of MD3 and the source electrode of MD4 are both coupled to PD1, and thus MD3 and MD4 are both in a reverse bias state.

In the second pull-down period td2, VDD2 outputs a high level, VDD1 outputs a low level, the potential of PD2 is at a high level, M_2 and M_3 are turned on, M_1 and M_4 are turned off, P2 is supplied with VSS, and P2 is coupled to PD2, so that MD3 and MD4 are turned on to release noise for PU and Output through MD3 and MD4, and the source electrode of MD1 and the source electrode of MD2 are both coupled to PD2, and thus MD1 and MD2 are in a reverse bias state.

In summary, in operation of the example shown in FIG. 4, the pull-down transistors are alternately in the forward stress state and the reverse bias state, so as to effectively alleviate the threshold drift of the pull-down transistors.

Figure 6:
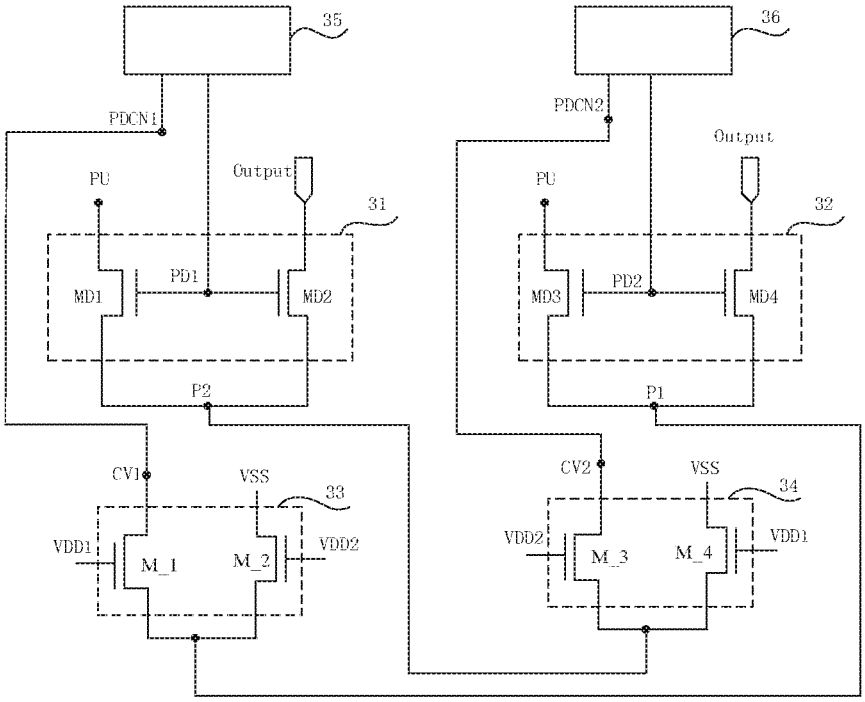
FIG. 6 is a circuit diagram of an example of a drift control circuit according to still another embodiment of the present disclosure.

Specifically, in the example of the drift control circuit shown in FIG. 6, on the basis of the drift control circuit shown in FIG. 1, the gate driving unit further includes a first pull-down node control module 35 and a second pull-down node control module 36.

The first pull-down node control module 35 is coupled to a first pull-down control node PDCN1 and the first pull-down node PD1, respectively, and the second pull-down node control module 36 is coupled to a second pull-down control node PDCN2 and the second pull-down node PD2, respectively.

The first control voltage terminal CV1 is coupled to the first pull-down control node PDCN1, and the second control voltage terminal CV2 is coupled to the second pull-down control node PDCN 2.

The first drift control sub-circuit 33 includes a first drift control transistor M_1 and a second drift control transistor M_2, a gate electrode of M_1 is coupled to the first drift control terminal VDD1, a drain electrode of M_1 is coupled to the first pull-down control node PDCN1, and a source electrode of M_1 is coupled to the first bias terminal P1; a gate electrode of M_2 is coupled to the second drift control terminal VDD2, a drain electrode of M_2 is supplied with the low voltage VSS, and a source electrode of M_2 is coupled to the first bias terminal P1; the first bias terminal P1 is coupled to the source electrode of MD3 and the source electrode of MD 4.

The second drift control sub-circuit 34 includes a third drift control transistor M_3 and a fourth drift control transistor M_4, a gate electrode of M_3 is coupled to the second drift control terminal VDD2, a drain electrode of M_3 is coupled to the second pull-down control node PDCN2, and a source electrode of M_3 is coupled to the second bias terminal P2; a gate electrode of M_4 is coupled to the first drift control terminal VDD1, a drain electrode of M_4 is supplied with the low voltage VSS, and a source electrode of M_4 is coupled to the second bias terminal P2; the second bias terminal P2 is coupled to the source electrode of the MD1 and the source electrode of the MD2.

In the embodiment shown in FIG. 6, each transistor is an N-type transistor, but the present disclosure is not limited thereto. In an embodiment, the transistors may also be replaced with P-type transistors.

When the drift control circuit shown in FIG. 6 is in operation, the display time includes a first pull-down period and a second pull-down period (during the display time, the first drift control signal output by VDD1 and the second drift control signal output by VDD2 are both clock signals, and the first drift control signal is inverted in phase with respect to the second drift control signal to control M_1 and M_2 to be alternately turned on and control M_3 and M_4 to be alternately turned on).

In the first pull-down period, VDD1 outputs a high level, VDD2 outputs a low level, the potential of PDCN1 is at a high level, M_1 and M_4 are turned on, M_2 and M_3 are turned off, PDCN1 is coupled to P1, and P2 is supplied with VSS, so that MD1 and MD2 are turned on to release noise for PU and Output through MD1 and MD2, and the source electrode of MD3 and the source electrode of MD4 are both coupled to PDCN1, and thus, MD3 and MD4 are both in a reverse bias state.

In the second pull-down period, VDD2 outputs a high level, VDD1 outputs a low level, the potential of PDCN2 is at a high level, M_2 and M_3 are turned on, M_1 and M_4 are turned off, P1 is supplied with VSS, and P2 is coupled to PDCN2, so that MD3 and MD4 are turned on to release noise for PU and Output through MD3 and MD4, and the source electrode of MD1 and the source electrode of MD2 are both coupled to PDCN2, and thus, MD1 and MD2 are in a reverse bias state.

In summary, the pull-down transistors are alternately in a forward stress state and a reverse bias state, so as to effectively alleviate the threshold drift of the pull-down transistors.

In an embodiment, the first pull-down node control module 35 may be further coupled to the pull-up node, the first drift control terminal VDD1 and the first pull-down node PD1, and the first pull-down node control module 35 is configured to control the potential of the first pull-down node PD1 under the control of the first drift control terminal VDD1 and the pull-up node, and a specific structure of the first pull-down node control module 35 will be described in detail when describing the gate driving unit.

In an embodiment, the second pull-down node control module 36 may be further coupled to the pull-up node, the second drift control terminal VDD2 and the second pull-down node PD2, and configured to control the potential of the second pull-down node PD2 under the control of the second drift control terminal VDD2 and the pull-up node, and a specific structure of the second pull-down node control module 36 will be described in detail when describing the gate driving unit.

A drift control method according to the embodiment of the present disclosure may be applied to the drift control circuit described above, The drift control method includes: when the first pull-down module performs noise releasing, inputting, by the first control voltage terminal, a first voltage to the first pull-down module, and controlling, by the first drift control sub-circuit, the first electrodes of the pull-down transistors included in the second pull-down module to be coupled to the first control voltage terminal; and when the second pull-down module performs noise releasing, inputting, by the second control voltage terminal, the first voltage to the second pull-down module, and controlling, by the second drift control sub-circuit, the first electrodes of the pull-down transistors included in the first pull-down module to be coupled to the second control voltage terminal.

In the drift control method according to the embodiment of the present disclosure, the first drift control sub-circuit and the second drift control sub-circuit may be adopted to control, when the first pull-down module performs noise releasing, the first electrodes of the pull-down transistors included in the second pull-down module to be supplied with the first voltage, so that the pull-down transistors included in the second pull-down module are in a reverse bias state, and control, when the second pull-down module performs noise releasing, the first electrodes of the pull-down transistors included in the first pull-down module to be supplied with the first voltage, so that the pull-down transistors included in the first pull-down module are in a reverse bias state, thereby alleviating the threshold voltage drift phenomenon of the pull-down transistors and improving reliability.

In an embodiment, the first pull-down module controls the noise releasing for the pull-up node and the gate driving signal output terminal under the control of the first pull-down node in the first pull-down period; and the second pull-down module controls the noise releasing for the pull-up node and the gate driving signal output terminal under the control of the second pull-down node in the second pull-down period.

According to an embodiment, the pull-down transistors are N-type transistors, the first voltage is of a high level, and the first drift control sub-circuit is configured to, in the first pull-down period, control the first electrodes of the pull-down transistors included in the second pull-down module to be supplied with the high level, so that the pull-down transistors included in the second pull-down module are in a reverse bias state, thus alleviating the threshold drift of the pull-down transistors included in the second pull-down module, and improving the reliability of the pull-down transistors; the second drift control sub-circuit is configured to, in the second pull-down period, control the first electrodes of the pull-down transistors included in the first pull-down module to be supplied with the high level, so that the pull-down transistors included in the first pull-down module are in a reverse bias state, thus alleviating the threshold drift of the pull-down transistors included in the first pull-down module, and improving the reliability of the pull-down transistors.

According to another embodiment, the pull-down transistors are P-type transistors, the first voltage is a low voltage, and the first drift control sub-circuit is configured to, in the first pull-down period, control the first electrodes of the pull-down transistors included in the second pull-down module to be supplied with the low voltage, so that the pull-down transistors included in the second pull-down module are in a reverse bias state, thus alleviating the threshold drift of the pull-down transistors included in the second pull-down module, and improving the reliability of the pull-down transistors; the second drift control sub-circuit is configured to, in the second pull-down period, control the first electrodes of the pull-down transistors included in the first pull-down module to be supplied with the low voltage, so that the pull-down transistors included in the first pull-down module are in a reverse bias state, thus alleviating the threshold drift of the pull-down transistors included in the first pull-down module, and improving the reliability of the pull-down transistors.

In an embodiment, the drift control method according to the embodiment of the present disclosure further includes: when the second pull-down module performs noise releasing, controlling, by the first drift control sub-circuit, the first electrodes of the pull-down transistors included in the second pull-down module to be supplied with the second voltage, so that the pull-down transistors included in the second pull-down module can be turned on; and when the first pull-down module performs noise releasing, controlling, by the second drift control sub-circuit, the first electrodes of the pull-down transistors included in the first pull-down module to be supplied with the second voltage, so that the pull-down transistors included in the first pull-down module can be turned on.

Specifically, when the pull-down transistors are N-type transistors, the second voltage may be a low voltage, and when the pull-down transistors are P-type transistors, the second voltage may be of a high level.

The gate driving unit according to the embodiment of the present disclosure includes the first pull-down module and the second pull-down module, the first pull-down module includes pull-down transistors, the gate electrodes of the pull-down transistors are coupled to the first pull-down node, the second pull-down module includes pull-down transistors, the gate electrodes of the pull-down transistors are coupled to the second pull-down node, an interconnection point between the gate electrodes of two pull-down transistors included in the first pull-down module is the first pull-down node, and an interconnection point between the gate electrodes of two pull-down transistors included in the second pull-down module is the second pull-down node.

The gate driving unit further includes the drift control circuit; the first drift control sub-circuit included in the drift control circuit is coupled to the first electrodes of the pull-down transistors included in the second pull-down module; and the second drift control sub-circuit included in the drift control circuit is coupled to the first electrodes of the pull-down transistors included in the first pull-down module.

Specifically, the first pull-down module may include a first pull-down transistor and a second pull-down transistor; a gate electrode of the first pull-down transistor is coupled to the first pull-down node, a first electrode of the first pull-down transistor is coupled to the second bias terminal, and a second electrode of the first pull-down transistor is coupled to the pull-up node; a gate electrode of the second pull-down transistor is coupled to the first pull-down node, a first electrode of the second pull-down transistor is coupled to the second bias terminal, and a second electrode of the second pull-down transistor is coupled to the gate driving signal output terminal.

The second pull-down module may include a third pull-down transistor and a fourth pull-down transistor; a gate electrode of the third pull-down transistor is coupled to the second pull-down node, a first electrode of the third pull-down transistor is coupled to the first bias terminal, and a second electrode of the third pull-down transistor is coupled to the pull-up node; a gate electrode of the fourth pull-down transistor is coupled to the second pull-down node, a first electrode of the fourth pull-down transistor is coupled to the first bias terminal, and a second electrode of the fourth pull-down transistor is coupled to the gate driving signal output terminal.

Specifically, the gate driving unit may further include a first pull-down node control module and a second pull-down node control module.

The first pull-down node control module includes a first pull-down node control transistor, a second pull-down node control transistor, a third pull-down node control transistor and a fourth pull-down node control transistor; a gate electrode and a first electrode of the first pull-down node control transistor are both coupled to the first drift control terminal, and a second electrode of the first pull-down node control transistor is coupled to the first pull-down control node; a gate electrode of the second pull-down node control transistor is coupled to the pull-up node, a first electrode of the second pull-down node control transistor is coupled to the first pull-down control node, and a second electrode of the second pull-down node control transistor is coupled to the second voltage terminal; a gate electrode of the third pull-down node control transistor is coupled to the first pull-down control node, a first electrode of the third pull-down node control transistor is coupled to the first drift control terminal, and a second electrode of the third pull-down node control transistor is coupled to the first pull-down node; a gate electrode of the fourth pull-down node control transistor is coupled to the pull-up node, a first electrode of the fourth pull-down node control transistor is coupled to the first pull-down node, and a second electrode of the fourth pull-down node control transistor is coupled to the second voltage terminal.

The second pull-down node control module includes a fifth pull-down node control transistor, a sixth pull-down node control transistor, a seventh pull-down node control transistor and an eighth pull-down node control transistor; a gate electrode and a first electrode of the fifth pull-down node control transistor are both coupled to the second drift control terminal, and a second electrode of the fifth pull-down node control transistor is coupled to the second pull-down control node; a gate electrode of the sixth pull-down node control transistor is coupled to the pull-up node, a first electrode of the sixth pull-down node control transistor is coupled to the second pull-down control node, and a second electrode of the sixth pull-down node control transistor is coupled to the second voltage terminal; a gate electrode of the seventh pull-down node control transistor is coupled to the second pull-down control node, a first electrode of the seventh pull-down node control transistor is coupled to the second drift control terminal, and a second electrode of the seventh pull-down node control transistor is coupled to the second pull-down node; a gate electrode of the eighth pull-down node control transistor is coupled to the pull-up node, a first electrode of the eighth pull-down node control transistor is coupled to the second pull-down node, and a second electrode of the eighth pull-down node control transistor is coupled to the second voltage terminal.

Figure 7:
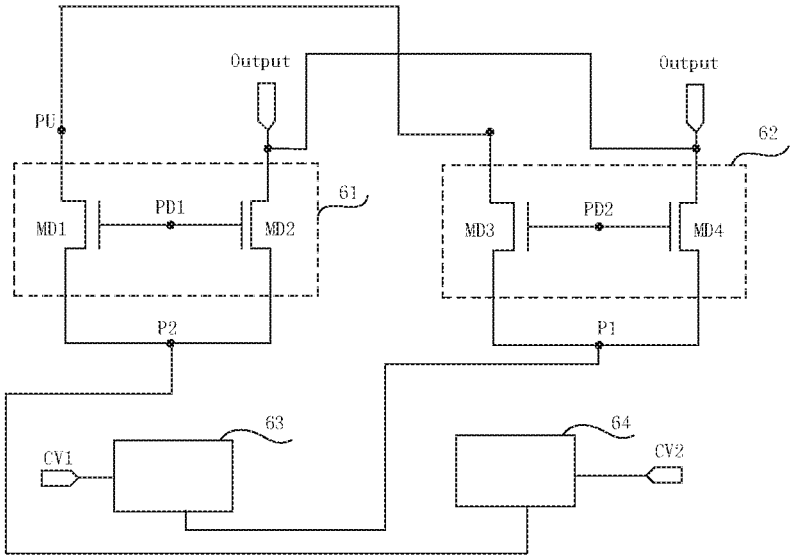
FIG. 7 is a circuit diagram of an example of a gate driving unit according to still another embodiment of the present disclosure.

As shown in FIG. 7, the gate driving unit according to the present disclosure may include a first pull-down node PD1, a second pull-down node PD2, a first pull-down module 61, a second pull-down module 62, and a drift control circuit.

The drift control circuit includes a first drift control sub-circuit 63 and a second drift control sub-circuit 64.

The first pull-down module 61 includes a first pull-down transistor MD1 and a second pull-down transistor MD2; the second pull-down module 62 includes a third pull-down transistor MD3 and a fourth pull-down transistor MD 4.

A gate electrode of the first pull-down transistor MD1 is coupled to the first pull-down node PD1, a drain electrode of the first pull-down transistor MD1 is coupled to the pull-up node PU, and a source electrode of the first pull-down transistor MD1 is coupled to the second bias terminal P2.

A gate electrode of the second pull-down transistor MD2 is coupled to the first pull-down node PD1, a drain electrode of the second pull-down transistor MD2 is coupled to the gate driving signal output terminal Output, and a source electrode of the second pull-down transistor MD2 is coupled to the second bias terminal P2.

A gate electrode of the third pull-down transistor MD3 is coupled to the second pull-down node PD2, a drain electrode of the third pull-down transistor MD3 is coupled to the pull-up node PU, and a source electrode of the third pull-down transistor MD3 is coupled to the first bias terminal P1.

A gate electrode of the fourth pull-down transistor MD4 is coupled to the second pull-down node PD2, a drain electrode of the fourth pull-down transistor MD4 is coupled to the gate driving signal output terminal Output, and a source electrode of the fourth pull-down transistor MD4 is coupled to the first bias terminal P1.

The first drift control sub-circuit 63 is coupled to the source electrode of the third pull-down transistor MD3 and the source electrode of the fourth pull-down transistor MD4 (i.e. the first drift control sub-circuit 63 is coupled to the first bias terminal P1), and the first drift control sub-circuit 63 is configured to, during a first pull-down period, control P1 to be coupled to the first control voltage terminal CV1 (CV1 outputs a high level during the first pull-down period), and control the potential of P1 to be a high level, so that both MD3 and MD4 are in a reverse bias state, thus alleviating the threshold voltage drift of MD3 and MD 4.

The second drift control sub-circuit 64 is coupled to the source electrode of the first pull-down transistor MD1 and the source electrode of the second pull-down transistor MD2 (i.e. the second drift control sub-circuit 64 is coupled to the second bias terminal P2), and the second drift control sub-circuit 64 is configured to, in the second pull-down period, control P2 to be coupled to the second control voltage terminal CV2 (CV2 outputs a high level in the second pull-down period), and control the potential of P2 to be a high level, so that MD1 and MD2 are both in a reverse bias state, thus alleviating the threshold voltage drift of MD1 and MD2.

In the example of the gate driving unit shown in FIG. 7, description is given by taking the case where MD1, MD2, MD3, and MD4 are N-type transistors as an example, but the present disclosure is not limited thereto.

Figure 8:
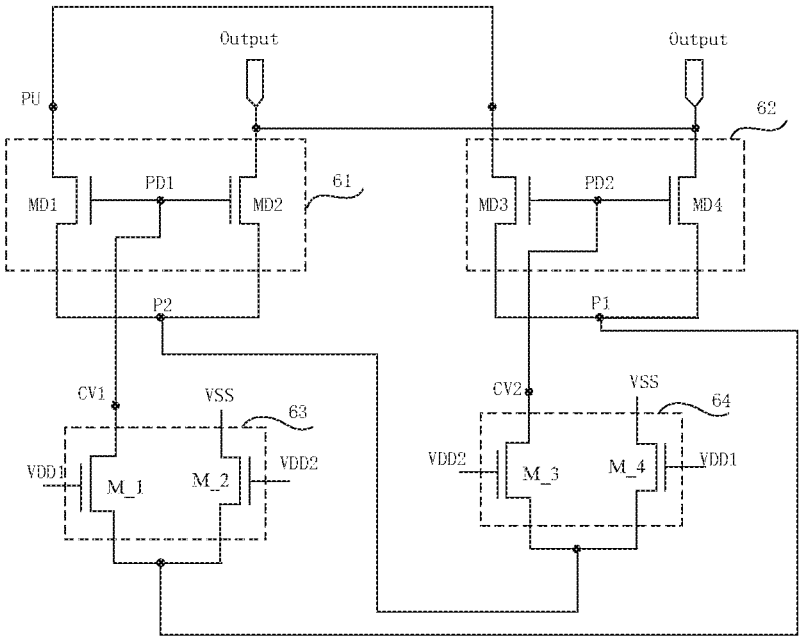
FIG. 8 is a circuit diagram of an example of a gate driving unit according to still another embodiment of the present disclosure.

In the example of the gate driving unit shown in FIG. 8, based on the example of the gate driving unit shown in FIG. 7, the first control voltage terminal CV1 is coupled to the first pull-down node PD1, and the second control voltage terminal CV2 is coupled to the second pull-down node PD2.

The first drift control sub-circuit 63 includes a first drift control transistor M_1 and a second drift control transistor M_2; a gate electrode of M_1 is coupled to the first drift control terminal VDD1, a drain electrode of M_1 is coupled to the first pull-down node PD1, and a source electrode of M_1 is coupled to the first bias terminal P1; a gate electrode of M_2 is coupled to the second drift control terminal VDD2, a drain electrode of M_2 is supplied with the low voltage VSS, and a source electrode of M_2 is coupled to the first bias terminal P1; the first bias terminal P1 is coupled to the source electrode of MD3 and the source electrode of MD4.

The second drift control sub-circuit 64 may include a third drift control transistor M_3 and a fourth drift control transistor M_4; a gate electrode of M_3 is coupled to the second drift control terminal VDD2, a drain electrode of M_3 is coupled to the second pull-down node PD2, and a source electrode of M_3 is coupled to the second bias terminal P2; a gate electrode of M_4 is coupled to the first drift control terminal VDD1, a drain electrode of M_4 is supplied with the low voltage VSS, and a source electrode of M_4 is coupled to the second bias terminal P2; the second bias terminal P2 is coupled to the source electrode of MD1 and the source electrode of MD2.

In the example shown in FIG. 8, all transistors are N-type transistors, but the present disclosure is not limited thereto. In an embodiment, the transistors described above may also be replaced with P-type transistors.

When the gate driving unit shown in FIG. 8 is in operation, the display time includes a first pull-down period and a second pull-down period (the first drift control signal output by VDD1 and the second drift control signal output by VDD2 are both clock signals, and the first drift control signal is inverted in phase with respect to the second drift control signal to control M_1 and M_2 to be alternately turned on and control M_3 and M_4 to be alternately turned on).

In the first pull-down period, VDD1 outputs a high level, VDD2 outputs a low level, the potential of PD1 is at a high level, M_1 and M_4 are turned on, M_2 and M_3 are turned off, P2 is supplied with VSS, P1 is coupled to PD1, so that MD1 and MD2 are turned on to release noise for PU and Output through MD1 and MD2, and the source electrode of MD3 and the source electrode of MD4 are both coupled to PD1, so that MD3 and MD4 are both in a reverse bias state.

In the second pull-down period, VDD2 outputs a high level, VDD1 outputs a low level, the potential of PD2 is at a high level, M_2 and M_3 are turned on, M_1 and M_4 are turned off, P1 is supplied with VSS, and P2 is coupled to PD2, so that MD3 and MD4 are turned on to release noise for PU and Output through MD3 and MD4, and the source electrode of MD1 and the source electrode of MD2 are both coupled to PD2, so that MD1 and MD2 are in a reverse bias state.

In summary, in operation of the examples shown in FIGS. 7 and 8, the pull-down transistors are alternately in the forward stress state and the reverse bias state to effectively alleviate the threshold drift of the pull-down transistors.

Figure 9:
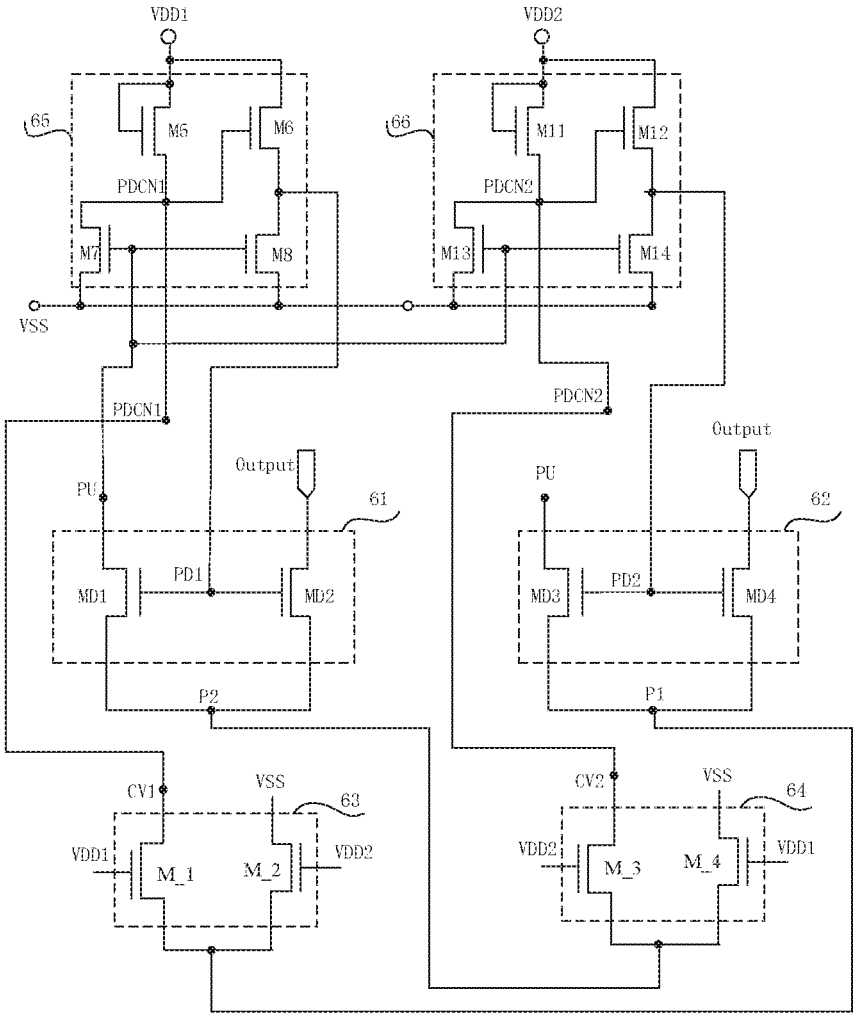
FIG. 9 is a circuit diagram of an example of a gate driving unit according to still another embodiment of the present disclosure.

In the example of the gate driving unit shown in FIG. 9, based on the example of the gate driving unit shown in FIG. 7, a first pull-down node control module 65 and a second pull-down node control module 66 may be further included.

The first control voltage terminal CV1 is coupled to a first pull-down control node PDCN1, and the second control voltage terminal CV2 is coupled to a second pull-down control node PDCN2.

The first drift control sub-circuit 63 includes a first drift control transistor M_1 and a second drift control transistor M_2; a gate electrode of M_1 is coupled to the first drift control terminal VDD1, a drain electrode of M_1 is coupled to the first pull-down control node PDCN2, and a source electrode of M_1 is coupled to the first bias terminal P1; a gate electrode of M_2 is coupled to the second drift control terminal VDD2, a drain electrode of M_2 is supplied with the low voltage VSS, and a source electrode of M_2 is coupled to the first bias terminal P1; the first bias terminal P1 is coupled to the source electrode of MD2 and the source electrode of MD 4.

The second drift control sub-circuit 64 may include a third drift control transistor M_3 and a fourth drift control transistor M_4; a gate electrode of M_3 is coupled to the second drift control terminal VDD2, a drain electrode of M_3 is coupled to the second pull-down control node PDCN2, and a source electrode of M_3 is coupled to the second bias terminal P2; a gate electrode of M_4 is coupled to the first drift control terminal VDD1, a drain electrode of M_4 is supplied with the low voltage VSS, and a source electrode of M_4 is coupled to the second bias terminal P2; the second bias terminal P2 is coupled to the source electrode of MD1 and the source electrode of MD2.

The first pull-down node control module 65 includes a first pull-down node control transistor M5, a second pull-down node control transistor M7, a third pull-down node control transistor M6 and a fourth pull-down node control transistor M8; a gate electrode and a drain electrode of M5 are coupled to the first drift control terminal VDD1, and a source electrode of M5 is coupled to the first pull-down control node PDCN1; a gate electrode of M7 is coupled to the pull-up node PU, a drain electrode of M7 is coupled to the first pull-down control node PDCN1, and a source electrode of M7 is supplied with the low voltage VSS; a gate electrode of M6 is coupled to the first pull-down control node PDCN1, a drain electrode of M6 is coupled to the first drift control terminal VDD1, and a source electrode of M6 is coupled to the first pull-down node PD1; a gate electrode of M8 is coupled to the pull-up node PU, a drain electrode of M8 is coupled to the first pull-down node PD1, and a source electrode of M8 is supplied with the low voltage VSS.

The second pull-down node control module 66 includes a fifth pull-down node control transistor M11, a sixth pull-down node control transistor M13, a seventh pull-down node control transistor M12 and an eighth pull-down node control transistor M14; a gate electrode and a drain electrode of M11 are both coupled to the second drift control terminal VDD2, and a source electrode of M11 is coupled to the second pull-down control node PDCN2; a gate electrode of M13 is coupled to the pull-up node PU, a drain electrode of M13 is coupled to the second pull-down control node PDCN2, and a source electrode of M13 is supplied with the low voltage VSS; a gate electrode of M12 is coupled to the second pull-down control node PDCN2, a drain electrode of M12 is coupled to the second drift control terminal VDD2, and a source electrode of M12 is coupled to the second pull-down node PD2; a gate electrode of M14 is coupled to the pull-up node PU, a drain electrode of M14 is coupled to the second pull-down node PD2, and a source electrode of M14 is supplied with the low voltage VSS.

In the example shown in FIG. 9, all transistors are N-type transistors, but the present disclosure is not limited thereto. In an embodiment, the transistors described above may also be replaced with P-type transistors.

When the gate driving unit shown in FIG. 9 is in operation, the display time includes a first pull-down period and a second pull-down period (the first drift control signal output by VDD1 and the second drift control signal output by VDD2 are both clock signals, and the first drift control signal is inverted in phase with respect to the second drift control signal to control M_1 and M_2 to be alternately turned on and control M_3 and M_4 to be alternately turned on).

In the first pull-down period, VDD1 outputs a high level, VDD2 outputs a low level, M5 is turned on, the potential of PDCN1 is at a high level, M6 is turned on, the potential of PD1 is at a high level, M_1 and M_4 are turned on, M_2 and M_3 are turned off, P2 is supplied with VSS, and P1 is coupled to PDCN1, so that MD1 and MD2 are turned on to release noise for PU and Output through MD1 and MD2, and the source electrode of MD3 and the source electrode of MD4 are both coupled to PDCN1, so that MD3 and MD4 are both in a reverse bias state.

In the second pull-down period, VDD2 outputs a high level, VDD1 outputs a low level, M11 is turned on, the potential of PDCN2 is at a high level, M12 is turned on, the potential of PD2 is at a high level, M_2 and M_3 are turned on, M_1 and M_4 are turned off, P1 is supplied with VSS, and P2 is coupled to PDCN2, so that MD3 and MD4 are turned on to release noise for PU and Output through MD3 and MD4, and the source electrode of MD1 and the source electrode of MD2 are both coupled to PDCN2, so that MD1 and MD2 are in a reverse bias state.

In summary, the pull-down transistors in FIG. 9 are alternately in the forward stress state and the reverse bias state, so as to effectively alleviate the threshold drift of the pull-down transistors.

In the example of the gate driving unit shown in FIG. 9 of the present disclosure, the first pull-down node control module 65 is configured to control the potential of PDCN1 to be a high level when VDD1 outputs a high level, thereby controlling the potential of PD1 to be a high level, and the second pull-down node control module 66 is configured to control the potential of PDCN2 to be a high level when VDD2 outputs a high level, thereby controlling the potential of PD2 to be a high level.

In an embodiment, the gate driving unit may further include an input module, a reset module, an output module, and a start module.

The input module is respectively coupled to an input terminal and the pull-up node and is configured to control the potential of the pull-up node under the control of the input terminal.

The reset module is respectively coupled to a first reset terminal, a second reset terminal, the pull-up node, the gate driving signal output terminal and a reset voltage terminal, and is configured to control the potential of the pull-up node under the control of the first reset terminal and control the potential of the gate driving signal output terminal under the control of the second reset terminal.

The output module is respectively coupled to the pull-up node, the gate driving signal output terminal and a clock signal input terminal and is configured to control the potential of the gate driving signal output terminal under the control of the pull-up node.

The start module is respectively coupled to a start control terminal (e.g., STV0 in FIG. 13), the pull-up node, the gate driving signal output terminal, and the start voltage terminal, and is configured to control the potential of the pull-up node and the potential of the gate driving signal output terminal under the control of the start control terminal.

In an embodiment, the reset voltage terminal and the start voltage terminal may be low voltage input terminals, but the present disclosure is not limited thereto. Specifically, in the example of the gate driving unit shown in FIG. 10, based on the example of the gate driving unit shown in FIG. 7, the gate driving unit further includes a first pull-down node control module 65, a second pull-down node control module 66, an input module 91, a reset module 92, an output module 93, and a start module 94.

The first drift control sub-circuit 63 is further coupled to the second pull-down node PD2, and the second drift control sub-circuit 64 is further coupled to the first pull-down node PD1.

The first pull-down node control module 65 is respectively coupled to the first drift control terminal VDD1, the first pull-down control node PDCN1, the pull-up node PU, the first pull-down node PD1, and a low voltage input terminal configured to input the low voltage VSS, and is configured to control the potential of the first pull-down node PD1 under the control of the first drift control terminal VDD1 and the pull-up node PU.

The second pull-down node control module 66 is respectively coupled to the second drift control terminal VDD2, the second pull-down control node PDCN2, the pull-up node PU, the second pull-down node PD2, and the low voltage input terminal configured to input the low voltage VSS, and is configured to control the potential of the second pull-down node PD2 under the control of the second drift control terminal VDD2 and the pull-up node PU.

The input module 91 is respectively coupled to the input terminal Input and the pull-up node PU, and is configured to control the potential of the pull-up node PU under the control of the input terminal Input.

The reset module 92 is respectively coupled to a first reset terminal Reset1, a second reset terminal Reset2, the pull-up node, the gate driving signal output terminal Output, and the low voltage input terminal configured to input the low voltage VSS, and is configured to control the potential of the pull-up node PU under the control of the first reset terminal Reset1, and control the potential of the gate driving signal output terminal Output under the control of the second reset terminal Reset2.

The output module 93 is respectively coupled to the pull-up node PU, the gate driving signal output terminal Output, and a clock signal input terminal CLK, and is configured to control the potential of the gate driving signal output terminal Output under the control of the pull-up node PU.

The start module 94 is respectively coupled to a start control terminal STV0, the pull-up node PU, the gate driving signal output terminal Output, and the low voltage input terminal configured to input the low voltage VSS, and is configured to control the potential of the pull-up node PU and the potential of the gate driving signal output terminal Output under the control of the start control terminal STV0.

Figure 10:
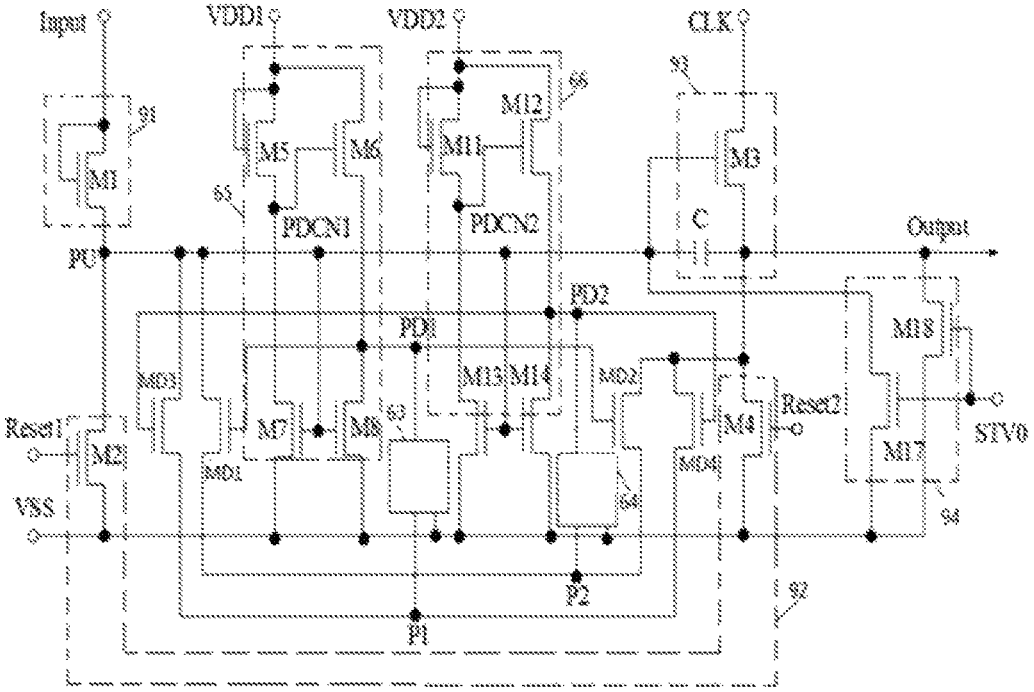
FIG. 10 is a circuit diagram of an example of a gate driving unit according to still another embodiment of the present disclosure.

In an embodiment, as shown in FIG. 10, the first pull-down node control module 65 may include a first pull-down node control transistor M5, a second pull-down node control transistor M7, a third pull-down node control transistor M6 and a fourth pull-down node control transistor M8; a gate electrode and a drain electrode of M5 are both coupled to the first drift control terminal VDD1, and a source electrode of M5 is coupled to the first pull-down control node PDCN1; a gate electrode of M7 is coupled to the pull-up node PU, a drain electrode of M7 is coupled to the first pull-down control node PDCN1, and a source electrode of M7 is supplied with the low voltage VSS; a gate electrode of M6 is coupled to the first pull-down control node PDCN1, a drain electrode of M6 is coupled to the first drift control terminal VDD1, and a source electrode of M6 is coupled to the first pull-down node PD1; a gate electrode of M8 is coupled to the pull-up node PU, a drain electrode of M8 is coupled to the first pull-down node PD1, and a source electrode of M8 is supplied with the low voltage VSS.

The second pull-down node control module 66 may include a fifth pull-down node control transistor M11, a sixth pull-down node control transistor M13, a seventh pull-down node control transistor M12 and an eighth pull-down node control transistor M14; a gate electrode and a drain electrode of M11 are both coupled to the second drift control terminal VDD2, and a source electrode of M11 is coupled to the second pull-down control node PDCN2; a gate electrode of M13 is coupled to the pull-up node PU, a drain electrode of M13 is coupled to the second pull-down control node PDCN2, and a source electrode of M13 is supplied with the low voltage VSS; a gate electrode of M12 is coupled to the second pull-down control node PDCN2, a drain electrode of M12 is coupled to the second drift control terminal VDD2, and a source electrode of M12 is coupled to the second pull-down node PD2; a gate electrode of M14 is coupled to the pull-up node PU, a drain electrode of M14 is coupled to the second pull-down node PD2, and a source electrode of M14 is supplied with the low voltage VSS.

The input module 91 may include an input transistor M1, a gate electrode and a drain electrode of M1 are both coupled to the input terminal Input, and a source electrode of M1 is coupled to the pull-up node PU.

The reset module 92 may include a pull-up reset transistor M2 and an output reset transistor M4; a gate electrode of M2 is coupled to the first reset terminal Reset1, a drain electrode of M2 is coupled to the pull-up node PU, and a source electrode of M2 is supplied with the low voltage VSS; a gate electrode of M4 is coupled to the second reset terminal Reset2, a drain electrode of M4 is coupled to the gate driving signal output terminal Output, and a source electrode of M4 is supplied with the low voltage VSS.

The output module 93 may include an output transistor M3 and a storage capacitor C; a gate electrode of M3 is coupled to the pull-up node PU, a drain electrode of M3 is coupled to the clock signal input terminal CLK, and a source electrode of M3 is coupled to the gate driving signal output terminal Output; a first terminal of the storage capacitor C is coupled to the pull-up node PU, and a second terminal of the storage capacitor C is coupled to the gate driving signal output terminal Output.

The start module 94 may include a pull-up start transistor M17 and an output start transistor M18; a gate electrode of M17 is coupled to the start control terminal STV0, a drain electrode of M17 is coupled to the pull-up node PU, and a source electrode of M17 is supplied with the low voltage VSS; a gate electrode of M18 is coupled to the start control terminal STV0, a drain electrode of M18 is coupled to the gate driving signal output terminal Output, and a source electrode of M18 is supplied with the low voltage VSS.

In the gate driving unit shown in FIG. 10, all transistors are N-type transistors, but the present disclosure is not limited thereto.

Figure 11:
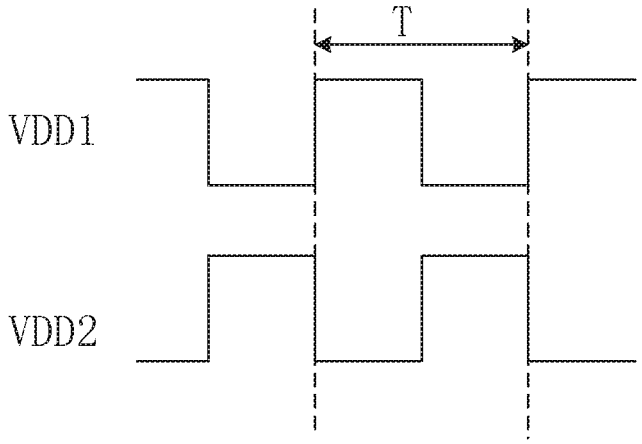
FIG. 11 is a waveform diagram of a first drift control signal output from VDD1 and a second drift control signal output from VDD2 in the example of the gate driving unit shown in FIG. 10.

As shown in FIG. 11, when the gate driving unit shown in FIG. 10 is in operation, the period T of the first drift control signal output from VDD1 and the period T of the second drift control signal output from VDD2 are set to 4 seconds, and the first drift control signal and the second drift control signal are inverted in phase. In general, T/2 includes a plurality of display periods (the display period is a display time of one frame). Since FIG. 12 shows only waveforms of signals in one display period, the first drift control signal output from VDD1 is at a high level, and the second drift control signal output from VDD2 is at a low level in FIG. 12.

Figure 12:
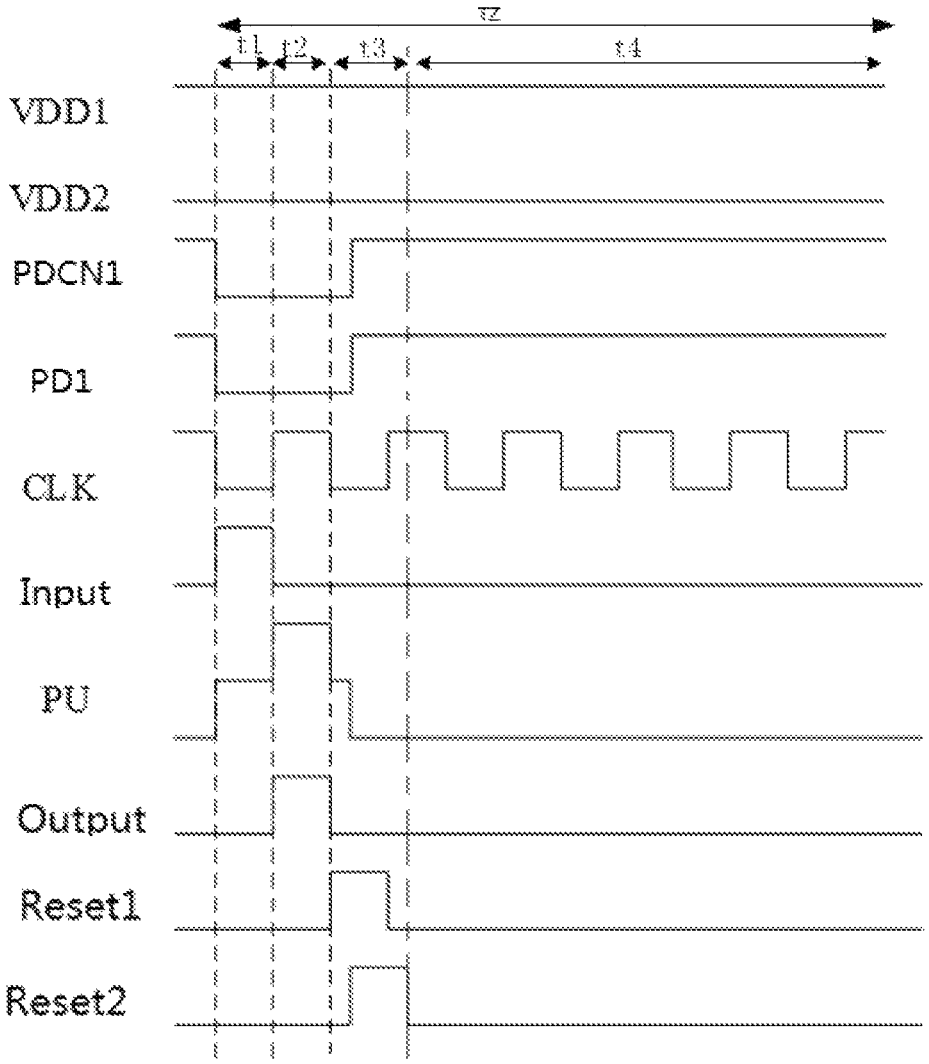
FIG. 12 is an operational timing diagram of the example of the gate driving unit shown in FIG. 10.

As shown in FIG. 12, when the gate driving unit shown in FIG. 10 is in operation, a display period TZ during which VDD1 outputs a high level and VDD2 outputs a low level is included in the first pull-down period.

As shown in FIG. 12, the display period TZ includes an input phase t1, an output phase t2, a reset phase t3, and an output-ending hold phase t4, which are sequentially arranged.

In the output-ending hold period t4 included in the display period TZ, since the potential of PU is at a low level and VDD1 outputs a high level, the potential of PDCN1 and the potential of PD1 are both at a high level, MD3 and MD4 are in a reverse bias state, and MD1 and MD2 are operated to release noise for PU and Output, respectively.

In the operation of the gate driving unit shown in FIG. 10 of the present disclosure, when VDD1 outputs a high level and VDD2 outputs a low level, M11 is turned off. During the input phase t1 and the output phase t2, the potential of PU is at a high level, and M13 and M14 are turned on, so that the potential of PDCN2 and the potential of PD2 are both pulled down to VSS, and during the reset phase t3 and the output-ending hold phase t4, since the potential of PU is at a low level, PD2 is in a floating state.

A gate driving method according to the embodiment of the present disclosure may be applied to the gate driving unit described above, and includes: when the first pull-down module performs noise releasing, inputting, by the first control voltage terminal, a first voltage to the first pull-down module, and controlling, by the first drift control sub-circuit, the first electrodes of the pull-down transistors included in the second pull-down module to be coupled to the first control voltage terminal; and when the second pull-down module performs noise releasing, inputting, by the second control voltage terminal, the first voltage to the second pull-down module, and controlling, by the second drift control sub-circuit, the first electrodes of the pull-down transistors included in the first pull-down module to be coupled to the second control voltage terminal.

Specifically, the gate driving unit may further include a first pull-down node control module and a second pull-down node control module; the first pull-down module is respectively coupled to the pull-up node and the gate driving signal output terminal, and the second pull-down module is respectively coupled to the pull-up node and the gate driving signal output terminal; the first pull-down node control module is respectively coupled to the first drift control terminal and the first pull-down node, the second pull-down node control module is respectively coupled to the second drift control terminal and the second pull-down node, the interconnection point of the gate electrodes of two pull-down transistors included in the first pull-down module is the first pull-down node, and the interconnection point of the gate electrodes of two pull-down transistors included in the second pull-down module is the second pull-down node.

The gate driving method includes: in the first pull-down period, inputting, by the first control voltage terminal, the first voltage to the first pull-down module, controlling, by the first pull-down node control module and under the control of the first drift control terminal, the potential of the first pull-down node to be the first voltage, controlling, by the second drift control sub-circuit, the first electrodes of the pull-down transistors included in the first pull-down module to be supplied with the second voltage, controlling, by the first pull-down module and under the control of the first pull-down node, noise releasing for the pull-up node and the gate driving signal output terminal, and controlling, by the first drift control sub-circuit, the first electrodes of the pull-down transistors included in the second pull-down module to be coupled to the first control voltage terminal; and in the second pull-down period, inputting, by the second control voltage terminal, the first voltage to the second pull-down module, controlling, by the second pull-down node control module and under the control of the second drift control terminal, the potential of the second pull-down node to be the first voltage, controlling, by the first drift control sub-circuit, the first electrodes of the pull-down transistors included in the second pull-down module to be supplied with the second voltage, controlling, by the second pull-down module and under the control of the second pull-down node, noise releasing for the pull-up node and the gate driving signal output terminal, and controlling, by the second drift control sub-circuit, the first electrodes of the pull-down transistors included in the first pull-down module to be coupled to the second control voltage terminal.

The display device according to the embodiment of the present disclosure may include the gate driving unit described above.

The display device provided in the embodiment of the present disclosure may be any product or component with a display function, such as a mobile phone, a tablet computer, a television, a display, a notebook computer, a digital photo frame, a navigator or the like.

Figure 13:
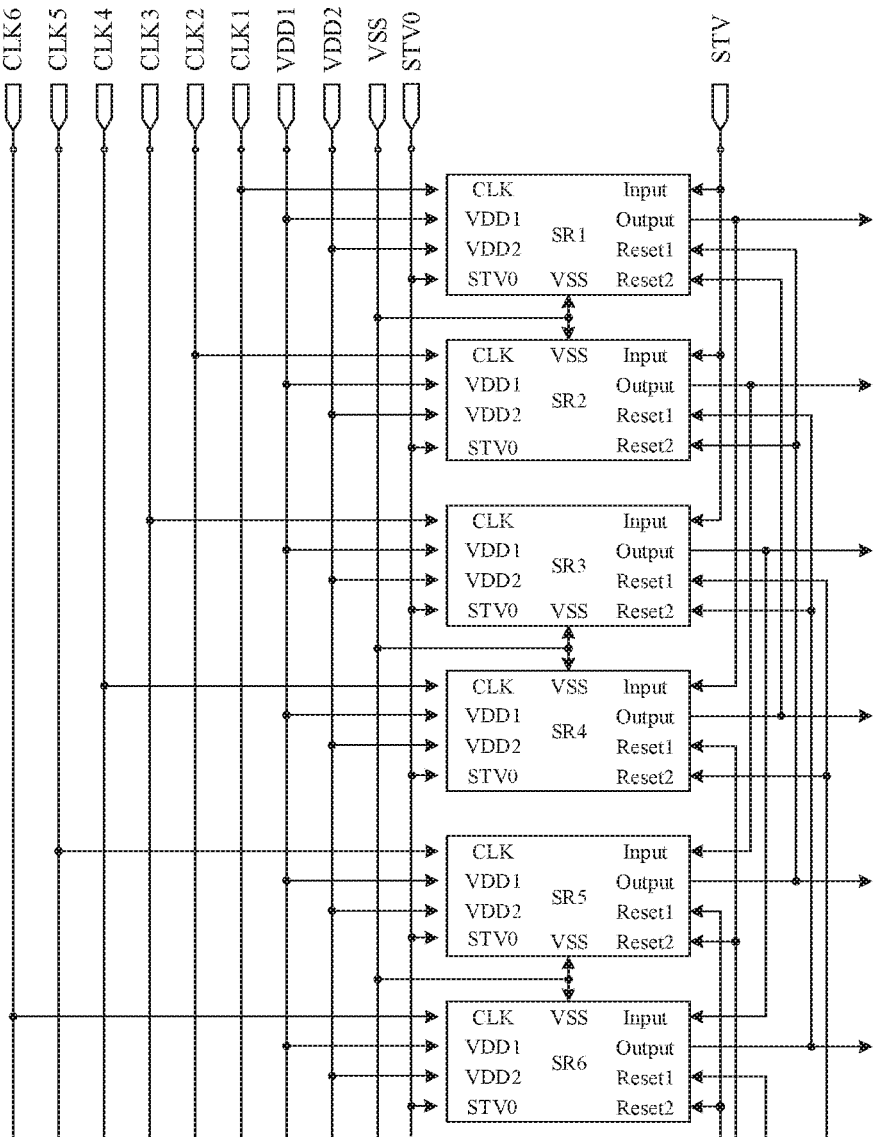
FIG. 13 is a structural diagram of a gate driving circuit included in a display device according to an embodiment of the present disclosure.

In an embodiment, as shown in FIG. 13, the display device includes a gate driving circuit; the gate driving circuit includes a plurality of stages of gate driving units as shown in FIG. 10.

In the gate driving circuit, six clock signal lines may be adopted: a first clock signal line CLK1, a second clock signal line CLK2, a third clock signal line CLK3, a fourth clock signal line CLK4, a fifth clock signal line CLK5, and a sixth clock signal line CLK 6.

A clock signal input terminal of a first-stage gate driving unit SR1 is coupled to CLK1, a clock signal input terminal of a second-stage gate driving unit SR2 is coupled to CLK2, a clock signal input terminal of a third-stage gate driving unit SR3 is coupled to CLK3, a clock signal input terminal of a fourth-stage gate driving unit SR4 is coupled to CLK4, a clock signal input terminal of a fifth-stage gate driving unit SR5 is coupled to CLK5, and a clock signal input terminal of a sixth-stage gate driving unit SR6 is coupled to CLK 6.

In FIG. 13, STV is a start signal.

As can be seen from FIG. 13, a gate driving signal output terminal of SR5 is respectively coupled to a first reset terminal of SR1 and a second reset terminal of SR2, a second reset terminal of SR1 is coupled to a gate driving signal output terminal of SR4, and a gate driving signal output terminal of SR6 is coupled to a first reset terminal of SR2 and a second reset terminal of SR3.

Description above is exemplary embodiments of the present disclosure. It should be noted that modifications and substitutions can be made by those skilled in the art without departing from the principles of the present disclosure and should be considered to be within the scope of the present disclosure.

The invention claimed is:

1. A drift control circuit applied to a gate driving unit, the gate driving unit comprising a first pull-down module and a second pull-down module, wherein the drift control circuit comprises a first drift control sub-circuit and a second drift control sub-circuit, the first drift control sub-circuit is configured to control first electrodes of pull-down transistors comprised in the second pull-down module to be coupled to a first control voltage terminal during noise releasing performed by the first pull-down module, and the first control voltage terminal is configured to input a first voltage to the first pull-down module during noise releasing performed by the first pull-down module; and the second drift control sub-circuit is configured to control first electrodes of pull-down transistors comprised in the first pull-down module to be coupled to a second control voltage terminal during noise releasing performed by the second pull-down module, the second control voltage terminal is configured to input the first voltage to the second pull-down module during noise releasing performed by the second pull-down module, wherein gate electrodes of the pull-down transistors comprised in the first pull-down module are coupled to a first pull-down node, and gate electrodes of the pull-down transistors comprised in the second pull-down module are coupled to a second pull-down node.

2. The drift control circuit of claim 1, wherein the first drift control sub-circuit is further configured to control the first electrodes of the pull-down transistors comprised in the second pull-down module to be supplied with a second voltage during noise releasing performed by the second pull-down module; and the second drift control sub-circuit is further configured to control the first electrodes of the pull-down transistors comprised in the first pull-down module to be supplied with the second voltage during noise releasing performed by the first pull-down module.

3. The drift control circuit of claim 1, wherein the first drift control sub-circuit comprises:

a first drift control transistor, a gate electrode of the first drift control transistor being coupled to a first drift control terminal, a first electrode of the first drift control transistor being coupled to a first bias terminal, and a second electrode of the first drift control transistor being coupled to the first control voltage terminal; and a second drift control transistor, a gate electrode of the second drift control transistor being coupled to a second drift control terminal, a first electrode of the second drift control transistor being coupled to the first bias terminal, and a second electrode of the second drift control transistor being coupled to a second voltage terminal, wherein the first bias terminal is coupled to the first electrodes of the pull-down transistors comprised in the second pull-down module.

4. The drift control circuit of claim 3, wherein the second drift control sub-circuit comprises:

a third drift control transistor, a gate electrode of the third drift control transistor being coupled to the second drift control terminal, a first electrode of the third drift control transistor being coupled to a second bias terminal, and a second electrode of the third drift control transistor being coupled to the second control voltage terminal; and a fourth drift control transistor, a gate electrode of the fourth drift control transistor being coupled to the first drift control terminal, a first electrode of the fourth drift control transistor being coupled to the second bias terminal, a second electrode of the fourth drift control transistor being coupled to the second voltage terminal, wherein the second bias terminal is coupled to the first electrodes of the pull-down transistors comprised in the first pull-down module.

5. The drift control circuit of claim 3, wherein the first control voltage terminal is couple to one of:

a first voltage terminal configured to provide the first voltage;

the first drift control terminal; and the first pull-down node.

6. The drift control circuit of claim 4, wherein the second control voltage terminal is couple to one of:

the first voltage terminal;

the second drift control terminal; and the second pull-down node.

7. The drift control circuit of claim 6, wherein in a case where the gate driving unit further comprises a first pull-down node control module, the first control voltage terminal is coupled to a first pull-down control node to which the first pull-down node control module is coupled.

8. The drift control circuit of claim 7, wherein in a case where the gate driving unit further comprises a second pull-down node control module, the second control voltage terminal is coupled to a second pull-down control node to which the second pull-down node control module is coupled.

9. A drift control method, applied to the drift control circuit of claim 1, the drift control method comprising:

during noise releasing performed by the first pull-down module, outputting, by the first control voltage terminal, the first voltage to the first pull-down module, and controlling, by the first drift control sub-circuit, the first electrodes of the pull-down transistors comprised in the second pull-down module to be coupled to the first control voltage terminal; and during noise releasing performed by the second pull-down module, inputting, by the second control voltage terminal, the first voltage to the second pull-down module, and controlling, by the second drift control sub-circuit, the first electrodes of the pull-down transistors comprised in the first pull-down module to be coupled to the second control voltage terminal.

10. A gate driving unit, comprising:

a first pull-down module comprising pull-down transistors, gate electrodes of which are coupled to a first pull-down node;

a second pull-down module comprising pull-down transistors, gate electrodes of which are coupled to a second pull-down node;

the drift control circuit of claim 1, wherein the drift control circuit comprises a first drift control sub-circuit coupled to first electrodes of the pull-down transistors comprised in the second pull-down module, and a second drift control sub-circuit coupled to first electrodes of the pull-down transistors comprised in the first pull-down module.

11. The gate driving unit of claim 10, wherein the first pull-down module comprises:

a first pull-down transistor, a gate electrode of the first pull-down transistor being coupled to the first pull-down node, a first electrode of the first pull-down transistor being coupled to a second bias terminal, and a second electrode of the first pull-down transistor being coupled to a pull-up node;

a second pull-down transistor, a gate electrode of the second pull-down transistor being coupled to the first pull-down node, a first electrode of the second pull-down transistor being coupled to the second bias terminal, and a second electrode of the second pull-down transistor being coupled to a gate driving signal output terminal;

the second pull-down module comprises:

a third pull-down transistor, a gate electrode of the third pull-down transistor being coupled to the second pull-down node, a first electrode of the third pull-down transistor being coupled to a first bias terminal, and a second electrode of the third pull-down transistor being coupled to the pull-up node; and a fourth pull-down transistor, a gate electrode of the fourth pull-down transistor being coupled to the second pull-down node, a first electrode of the fourth pull-down transistor being coupled to the first bias terminal, and a second electrode of the fourth pull-down transistor being coupled to the gate driving signal output terminal.

12. The gate driving unit of claim 10, wherein the gate driving unit further comprises a first pull-down node control module and a second pull-down node control module;

the first pull-down node control module comprises:

a first pull-down node control transistor, a gate electrode and a first electrode of the first pull-down node control transistor being both coupled to a first drift control terminal, and a second electrode of the first pull-down node control transistor being coupled to a first pull-down control node;

a second pull-down node control transistor, a gate electrode of the second pull-down node control transistor being coupled to a pull-up node, a first electrode of the second pull-down node control transistor being coupled to the first pull-down control node, and a second electrode of the second pull-down node control transistor being coupled to a second voltage terminal;

a third pull-down node control transistor, a gate electrode of the third pull-down node control transistor being coupled to the first pull-down control node, a first electrode of the third pull-down node control transistor being coupled to the first drift control terminal, and a second electrode of the third pull-down node control transistor being coupled to the first pull-down node; and a fourth pull-down node control transistor, a gate electrode of the fourth pull-down node control transistor being coupled to the pull-up node, a first electrode of the fourth pull-down node control transistor being coupled to the first pull-down node, and a second electrode of the fourth pull-down node control transistor being coupled to the second voltage terminal, and the first pull-down node control module is configured to control a potential of the first pull-down control node under control of the first drift control terminal and to control a potential of the first pull-down node under control of the first pull-down control node;

the second pull-down node control module comprises:

a fifth pull-down node control transistor, a gate electrode and a first electrode of the fifth pull-down node control transistor being both coupled to a second drift control terminal, and a second electrode of the fifth pull-down node control transistor being coupled to a second pull-down control node;

a sixth pull-down node control transistor, a gate electrode of the sixth pull-down node control transistor being coupled to the pull-up node, a first electrode of the sixth pull-down node control transistor being coupled to the second pull-down control node, and a second electrode of the sixth pull-down node control transistor being coupled to the second voltage terminal;

a seventh pull-down node control transistor, a gate electrode of the seventh pull-down node control transistor being coupled to the second pull-down control node, a first electrode of the seventh pull-down node control transistor being coupled to the second drift control terminal, and a second electrode of the seventh pull-down node control transistor being coupled to the second pull-down node; and an eighth pull-down node control transistor, a gate electrode of the eighth pull-down node control transistor being coupled to the pull-up node, a first electrode of the eighth pull-down node control transistor being coupled to the second pull-down node, and a second electrode of the eighth pull-down node control transistor being coupled to the second voltage terminal, and the second pull-down node control module is configured to control a potential of the second pull-down control node under control of the second drift control terminal, and to control a potential of the second pull-down node under control of the second pull-down control node.

13. The gate driving unit of claim 10, further comprising an input module, a reset module, an output module and a start module, wherein the input module is respectively coupled to an input terminal and a pull-up node and configured to control a potential of the pull-up node under control of the input terminal, the reset module is respectively coupled to a first reset terminal, a second reset terminal, the pull-up node, a gate driving signal output terminal and a reset voltage terminal, and configured to control the potential of the pull-up node under control of the first reset terminal and control a potential of the gate driving signal output terminal under control of the second reset terminal, the output module is respectively coupled to the pull-up node, the gate driving signal output terminal and a clock signal input terminal, and configured to control the potential of the gate driving signal output terminal under control of the pull-up node, and the start module is respectively coupled to a start control terminal, the pull-up node, the gate driving signal output terminal and the start voltage terminal and configured to control the potential of the pull-up node and the potential of the gate driving signal output terminal under control of the start control terminal.

14. A gate driving method, applied to the gate driving unit of claim 10, the gate driving method comprising:

during noise releasing performed by the first pull-down module, inputting, by a first control voltage terminal, a first voltage to the first pull-down module, and controlling, by the first drift control sub-circuit, the first electrodes of the pull-down transistors comprised in the second pull-down module to be coupled to the first control voltage terminal; and during noise releasing performed by the second pull-down module, inputting, by a second control voltage terminal, the first voltage to the second pull-down module, and controlling, by the second drift control sub-circuit, the first electrodes of the pull-down transistors comprised in the first pull-down module to be coupled to the second control voltage terminal.

15. The gate driving method of claim 14, wherein the gate driving unit further comprises a first pull-down node control module and a second pull-down node control module, and the gate driving method comprises:

in a first pull-down period, inputting, by the first control voltage terminal, the first voltage to the first pull-down module, controlling, by the first pull-down node control module and under control of the first drift control terminal, a potential of the first pull-down node to be the first voltage, controlling, by the second drift control sub-circuit, the first electrodes of the pull-down transistors comprised in the first pull-down module to be supplied with a second voltage, controlling, by the first pull-down module and under control of the first pull-down node, noise releasing for the pull-up node and the gate driving signal output terminal, and controlling, by the first drift control sub-circuit, the first electrodes of the pull-down transistors comprised in the second pull-down module to be coupled to the first control voltage terminal; and in a second pull-down period, inputting, by the second control voltage terminal, the first voltage to the second pull-down module, controlling, by the second pull-down node control module and under control of the second drift control terminal, a potential of the second pull-down node to be the first voltage, controlling, by the first drift control sub-circuit, the first electrodes of the pull-down transistors comprised in the second pull-down module to be supplied with the second voltage, controlling, by the second pull-down module and under control of the second pull-down node, noise releasing for the pull-up node and the gate driving signal output terminal, and controlling, by the second drift control sub-circuit, the first electrodes of the pull-down transistors comprised in the first pull-down module to be coupled to the second control voltage terminal, wherein the first pull-down module is respectively coupled to the pull-up node and the gate driving signal output terminal, and the second pull-down module is respectively coupled to the pull-up node and the gate driving signal output terminal, the first pull-down node control module is respectively coupled to the first drift control terminal and the first pull-down node, the second pull-down node control module is respectively coupled to the second drift control terminal and the second pull-down node, an interconnection point of the gate electrodes of two pull-down transistors comprised in the first pull-down module is the first pull-down node, and an interconnection point of the gate electrodes of two pull-down transistors comprised in the second pull-down module is the second pull-down node.

16. The gate driving method of claim 15, wherein a signal output by the first drift control terminal and a signal output by the second drift control terminal have a same period but opposite phases.

17. The gate driving method of claim 16, wherein one of a first half period and a second half period of the period is the first pull-down period, and the other of the first half period and the second half period of the period is the second pull-down period.

18. A display device, comprising the gate driving unit of claim 10.

* * * * *